US005498172A

United States Patent [19]

Noda

[11] Patent Number: 5,498,172

[45] Date of Patent: Mar. 12, 1996

[54] ELECTRICAL CONNECTOR FOR INTERCONNECTING PARALLEL MULTICONDUCTOR CABLES

[75] Inventor: Sadao Noda, Iwakura, Japan

[73] Assignee: Sunx Kabushiki Kaisha, Tokyo, Japan

[21] Appl. No.: 267,362

[22] Filed: Jun. 29, 1994

[30] Foreign Application Priority Data

| | | | |
|---|---|---|---|
| Jul. 30, 1993 | [JP] | Japan | 5-042049 U |
| Sep. 10, 1993 | [JP] | Japan | 5-049345 U |
| Sep. 10, 1993 | [JP] | Japan | 5-225573 |

[51] Int. Cl.[6] ..... H01R 4/24

[52] U.S. Cl. ..... 439/404; 439/417

[58] Field of Search ..... 439/395–404, 439/350, 351, 357, 417–419

[56] References Cited

U.S. PATENT DOCUMENTS

| | | | |
|---|---|---|---|
| 4,552,429 | 11/1985 | van Alst | 439/404 |
| 4,668,039 | 5/1987 | Marzilli | 439/404 |
| 4,897,041 | 1/1990 | Heiney et al. | 439/404 |
| 5,009,612 | 4/1991 | Rishworth et al. | 439/403 |
| 5,199,899 | 4/1993 | Ittah | 439/404 |
| 5,338,220 | 8/1994 | Soes et al. | 439/403 |
| 5,376,018 | 12/1994 | Davis et al. | 439/404 |

*Primary Examiner*—David L. Pirlot
*Attorney, Agent, or Firm*—Foley & Lardner

[57] ABSTRACT

An electrical connector for interconnecting parallel multiconductor cables includes a housing having a first cable receiving section for receiving a parallel multiconductor main cable and a second cable receiving section for receiving a parallel multiconductor branch cable respectively. Contact members each extend through the housing and have terminal portions projecting from the first and second cable receiving sections so that the main and branch cables are press fitted into the terminal portions. A pair of covers are attached to the housing and each have cable receiving sections pressing the main and branch cables against the first and second cable receiving sections respectively in the condition that the covers are attached to the housing. The housing is engaged with each cover in a state that each cover has been attached to the housing. Each cover is held in a provisional engagement state in which each cover is away from the housing by a predetermined distance, in a process that the covers are attached to the housing.

22 Claims, 27 Drawing Sheets

ELECTRICAL CONNECTOR FOR INTERCONNECTING PARALLEL MULTICONDUCTOR CABLES

BACKGROUND OF THE INVENTION

1. Field of the Invention

This invention relates to an electrical connector for electrically interconnecting parallel multiconductor main and branch cables together.

2. Description of the Prior Art

A control unit and a plurality of input and output units are interconnected together by cables for the purpose of factory automation, for example, so that signals are transmitted between the control unit and each of the input and output units. The number of cabling equal to the number of the input and output units is required in this regard. Accordingly, as the number of the input and output units is increased, cabling becomes more troublesome and a space for cabling becomes larger.

In view of the above problem, the prior art has recently provided for signal transmission systems with saved cabling wherein the minimum number of signal lines is employed for the signal transmission between the control unit and the input and output units. FIG. 38 illustrates one of such signal transmission systems. One end of a flat four-wire main cable 2 is connected to a control unit 1. Electrical connectors 4 are provided for electrically connecting one ends of branch cables 3 to the main cable 2 respectively. Address units 5 are connected to the other ends of the branch cables 3 respectively. A plurality of input or output units 6 or 7 are connected to each address unit 5.

When data is delivered from the control unit 1 to each output unit 7, the control unit 1 delivers to the address unit 5 a data signal representative of output data and address data of the output unit 7 to which the output data is to be supplied. The address unit 5 specifies the output unit 7 to which the output data is to be supplied, on the basis of the address data of the data signal delivered thereto. The address unit 5 then delivers the output data to the specified output unit 7. On the other hand, when inputting data from each input unit 6, each address unit 5 delivers a data signal with address data to the control unit 1. The control unit 1 specifies the input unit 6 from which the data has been input, on the basis of the address data of the data signal supplied thereto from the address unit 5.

The main and branch cables 2, 3 are interconnected by the connector 4 in the following manner. The main cable 2 is cut off at a desired branch point. Both cut ends of the main cable 2 are connected to a connecting member and then, another connecting member is attached to the end of the branch cable 3. These two connecting members are interconnected together by a further another connecting member. Accordingly, the main cable 2 needs to be cut off at the number of times corresponding to the number of the branch cables 3, and three connecting members are required at each branch point. Consequently, cabling becomes troublesome and the number of the connectors connecting between the main and branch cables is increased with the result of increase in the cost for the factory automation.

To solve the above-described drawback, Japanese Unexamined Patent Application Publication No. 3-171572 discloses an electrical connector for interconnecting flat multiconductor cables.. The disclosed connector electrically connects between an intermediate portion of a flat multiconductor main cable 2 and a branch cable 3, as shown in FIGS. 39 to 41. The intermediate portion of the main cable 2 is placed on the upper face of a housing 8. In this state, an upper pressing member 9 is pressed from upward and a lower pressing member 10 is pressed from below. Consequently, the main and branch cables 2, 3 are press fitted into concave portions of connecting members 11 projecting from the upper and bottom faces of the housing 8, thereby being electrically connected to the connecting members 11, respectively. The main and branch cables 2, 3 are thus connected electrically together.

In the above-described conventional construction, however, the main cable 2 needs to be positioned on the housing 8 and then, the upper pressing member 9 needs to be pressed against the housing 8 when the branch of the main cable 2 is attached to the housing 8. The housing 8 sometimes slips out of the branch position of the main cable 2 while the upper pressing member 9 is being pressed. This reduces the working efficiency for connection and reliability in the connection.

SUMMARY OF THE INVENTION

Therefore, an object of the present invention is to provide an electrical connector for interconnecting parallel multiconductor cables, wherein the connecting work can be performed with ease and reliability when the main and branch cables are interconnected together.

The present invention provides an electrical connector for interconnecting parallel multiconductor cables, comprising a housing with opposite sides having a first cable receiving section for receiving a parallel multiconductor main cable and a second cable receiving section for receiving a parallel multiconductor branch cable respectively. A plurality of contact members each extend through the housing. Each contact member has terminal portions projecting from the first and second cable receiving sections so that the main and branch cables are press fitted into the terminal portions in an electrically conductive state respectively. A pair of covers are attached to the housing. The covers have cable receiving sections pressing the main and branch cables against the first and second cable receiving sections respectively when the covers are attached to the housing. Engagement means is provided for engaging the housing with each cover in a state that each cover has been attached to the housing. The engagement means holds each cover in a provisional engagement state wherein each cover is away from the housing by a predetermined distance, when the covers are attached to the housing.

When having been attached to the housing of the above-described connector, the covers are fixed to the housing by the engagement means, whereupon the main and branch cables are press fitted into the contact members. Thus, the main and branch cables are electrically interconnected through the contact members.

Since the connector is slidable relative to the main and branch cables in the provisional engagement state in the above-described construction, the cables can be attached to the connector with ease.

The above-described construction may be modified so that the engagement means holds each cover in first and second provisional engagement states in turn when the covers are attached to the housing. Each cover is away from the housing by different distances in the first and second provisional engagement states. The connector can be set to be movable relative to the main and branch cables in the first provisional engagement state. The connector is semifixed to the cables in the second provisional engagement state. Consequently, positioning the cables and attaching them to the housing can be performed with further ease.

In a preferred form, the housing is formed into the shape of a square block. The first and second cable receiving sections are disposed to receive the main and branch cables respectively when the main and branch cables intersect each other. The contact members are arranged to be located on a diagonal of the first and second cable receiving sections. The cutting edges of the terminal portions on the respective first and second cable receiving sections intersect each other.

In another preferred form, the housing is formed into the shape of a square block, and the first and second cable receiving sections are disposed to receive the main and branch cables respectively when the main and branch cables intersect each other. Each contact member has terminal portions at both ends thereof respectively and a connecting portion having a width smaller than the terminal portions and connecting between the terminals. The housing has a plurality of attachment portions each comprising a through-hole into which the connecting portion of the contact member is inserted so that the connecting portion is located on a diagonal of the first and second cable receiving sections of the housing. The housing further includes first and second engagement walls engaging the respective terminal portions of the contact member so that the first and second engagement walls are away from each other by 90 degrees, and a plurality of attachment portions each including first and second receiving portions preventing the respective terminal portions of each contact member from moving axially of each contact member when the terminal portions of each contact member are engaged with the first and second engagement walls respectively. Each cover has grooves the terminal portions of each contact member invade when the covers have been attached to the housing.

When attached to the housing in the above-described construction, each contact member is inserted into the through hole of the attachment portion so that the connecting portion of the contact member is located in the hole. Each contact member is then twisted such that the terminal portions thereof are engaged with the first and second engagement walls respectively. Consequently, the terminal portions of each contact member are received by the first and second receiving faces respectively, whereby the axial movement of each contact member is prevented.

BRIEF DESCRIPTION OF THE DRAWINGS

Other objects, features and advantages of the present invention will become clear upon reviewing the following reference to the accompanying drawings, in which.

DESCRIPTION OF THE PREFERRED EMBODIMENTS

Figure 1:
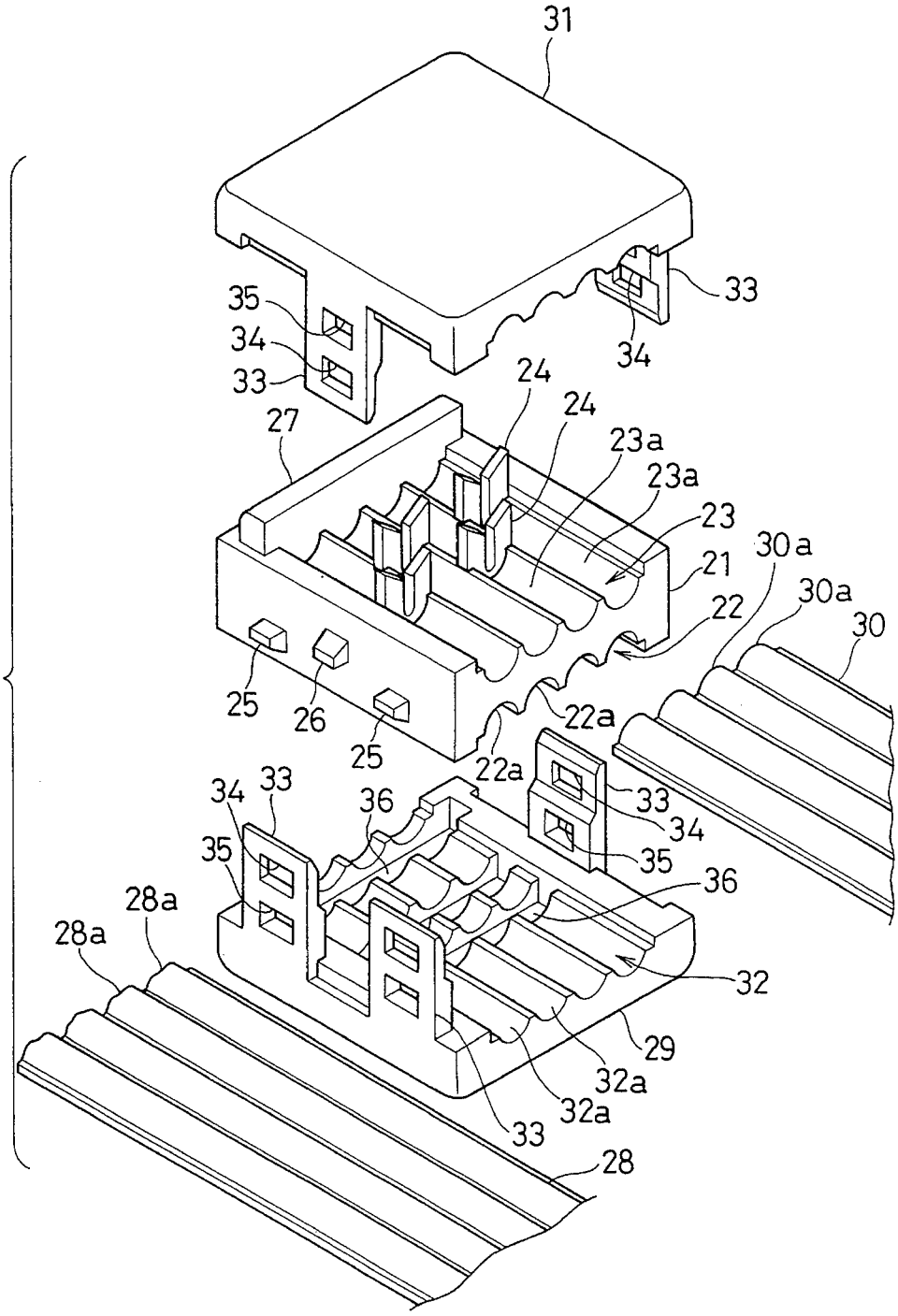
FIG. 1 is an exploded perspective view of a first embodiment of an electrical connector for interconnecting parallel multiconductor cables in accordance with the present invention.
Figure 2:
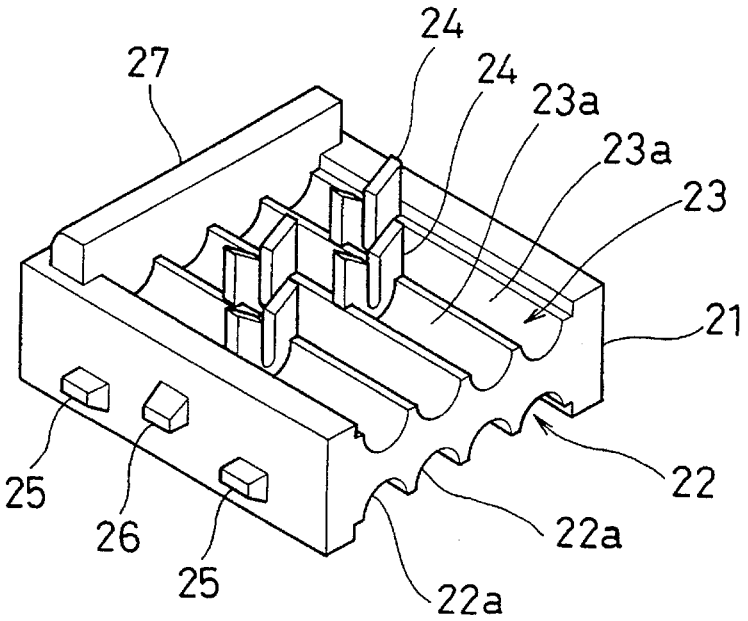
FIG. 2 is a perspective view of a housing showing the left-hand side thereof.
Figure 3:
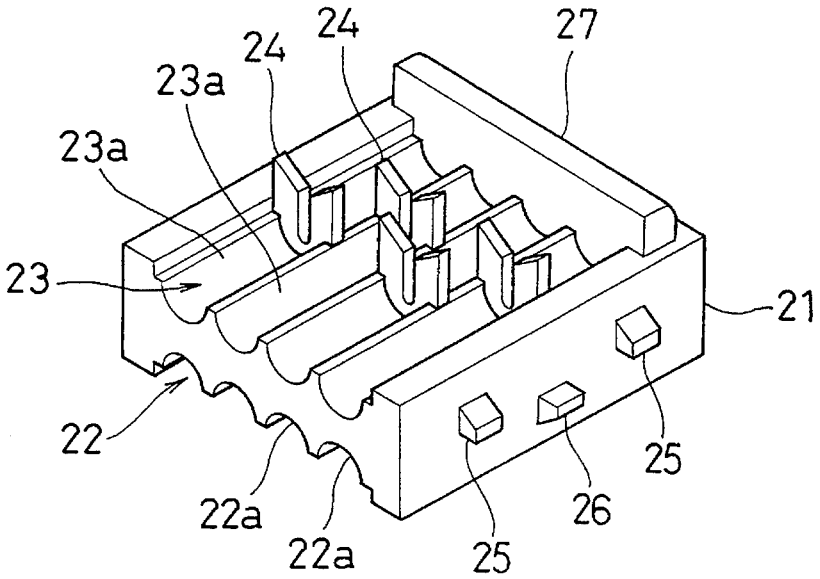
FIG. 3 is a perspective view of the housing showing the the right-hand side thereof.
Figure 4:
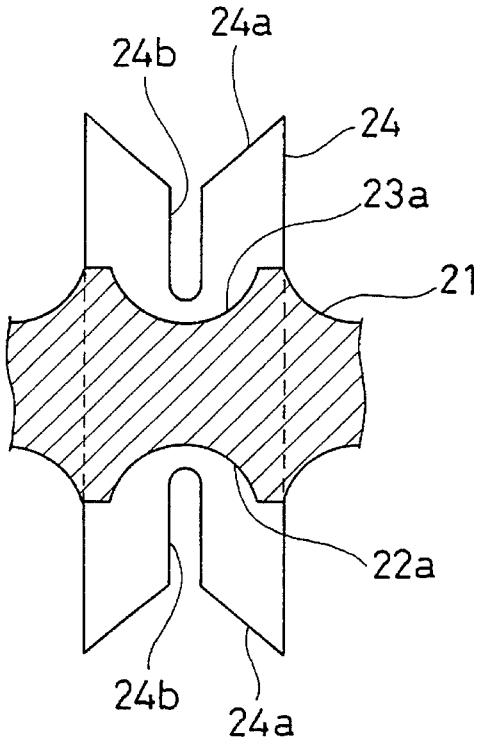
FIG. 4 is a partially longitudinal sectional view of the housing with a contact member attached thereto.

A first embodiment of the present invention will be described with reference to FIGS. 1 to 7. Referring to FIGS. 2 and 3, a housing 21 formed of an insulating material has a first cable receiving section 22 on its lower face and a second cable receiving section 23 on its upper face. The cable receiving sections 22, 23 has a plurality of parallel positioning grooves 22*a* and 23*a* respectively. Each groove 22*a*, 23*a* has an arc cross section. A plurality of contact members 24 each formed from a copper alloy are provided by way of injection molding so as to project from the respective grooves 22*a*, 23*a*. Each contact member 24 has generally V-shaped cutting portions 24*a* in both ends thereof and slits 24*b* contiguous thereto respectively, as shown in FIG. 4. The cutting portions 24*a* and the slits 24*b* of each contact member 24 are exposed out of the housing 21. The contact members 24 are disposed so that the adjacent contact members 24 can be prevented from interfering with each other.

The housing 21 has a plurality of engagement projections 25 and 26 formed on opposite sides thereof so as to assume predetermined locations respectively. More specifically, two projections 25 have inclined lower faces respectively in the housing 21 shown in FIG. 2. One projection 26 is disposed between the projections 25 to be located higher than the projections 25 and has an inclined upper face. A wall 27 extends across one ends of the positioning grooves 23*a* of the second cable receiving sections 23. The first cable receiving section 22 has no such wall.

Figure 5:
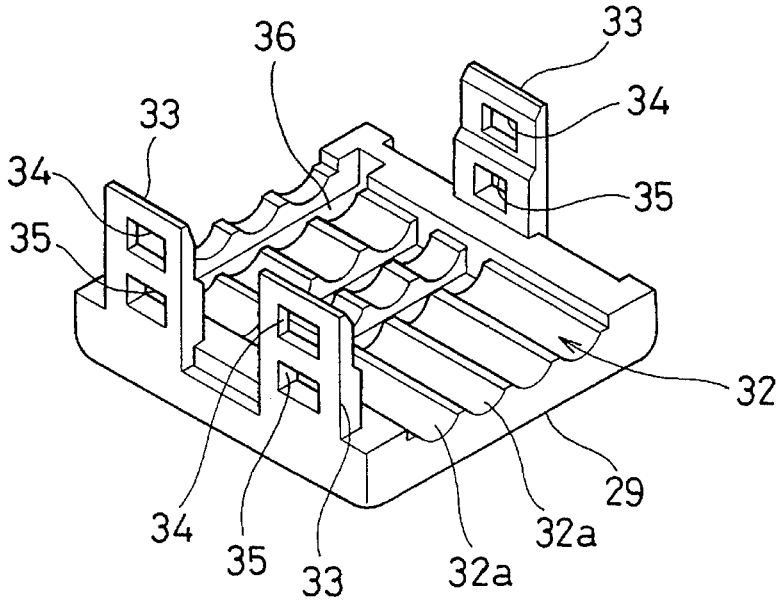
FIG. 5 is a perspective view of a cover of the connector.

A cover 29 is attached to the first cable receiving section 22 so that a main cable 28 is held therebetween. Another cover 31 is attached to the second cable receiving section 23 so that a branch cable 30 is held therebetween. Since the covers 29, 31 have the same construction, only the cover 29 will be described. Referring to FIG. 5, the cover 29 has a cable receiving section 32 formed in the inside thereof. The cable receiving section 32 includes a plurality of parallel positioning grooves 32*a* each having an arc cross section. Two engagement pieces 33 project upwardly from one side wall of the cover 29. One engagement piece 33 projects upwardly from the central opposite side wall of the cover 29. Each engagement piece 33 is formed to fit with the housing 21. Each engagement piece 33 has an upper first engagement hole 34 and a lower second engagement hole 35. The thickness of each engagement piece 33 is reduced in the inside of the portion of the first engagement hole 34 as compared with the portion of the second engagement hole 35. The cover 29 has a slit 36 extending across the positioning grooves 32*a* and positioned so as to correspond to the contact members 24 and the wall 27 of the housing 21.

Assembly of the connector will now be described. First, the cable wires 28*a* of the flat multiconductor main cable 28 are placed on the respective positioning grooves 32*a* of the cable receiving section 32 of the cover 29. When the housing 21 is thrust against the cover 29 from above, the engagement pieces 33 of the cover 29 are pressed by the inclined faces of the corresponding engagement projections 25 of the housing 21 such that the engagement pieces 33 are elastically deformed. When the housing 21 is further thrust against the cover 29, the engagement projections 25 are engaged with the first engagement holes 34 respectively.

Figure 6:
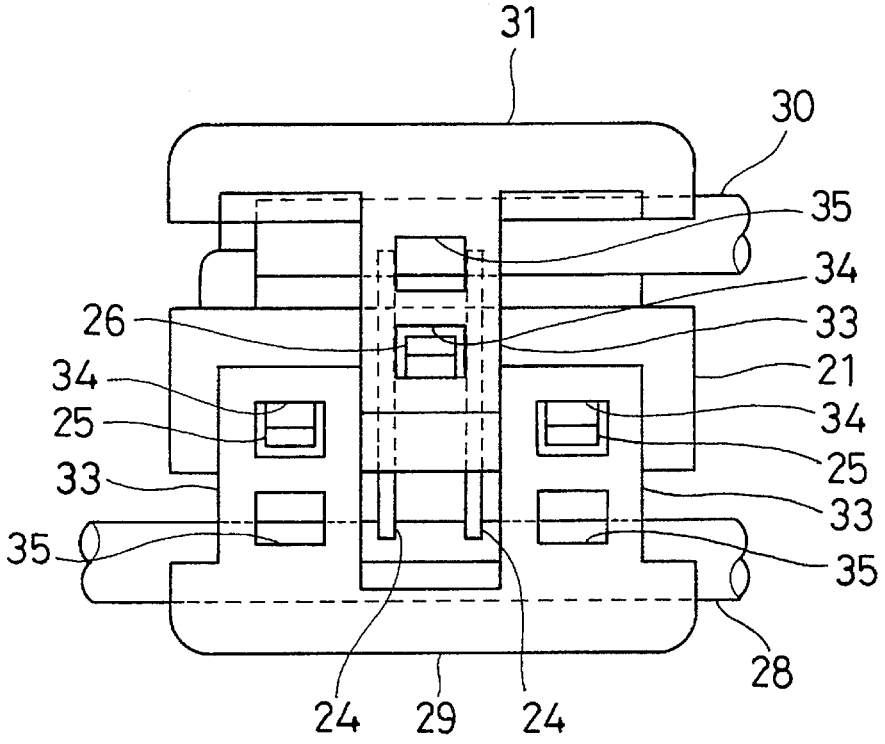
FIG. 6 is a side view of the connector in a provisional engagement state.

Subsequently, the end of the branch cable 30 is caused to abut against the wall 27 of the second cable receiving section 23 of the housing 21, and the cable wires 30*a* of the branch cable 30 are positioned in the respective grooves 23*a*. In this state, the cover 31 is thrust against the second cable receiving section 23 of the housing 21. Thrusting is completed when the engagement projections 26 formed on the housing 21 have been engaged with the first engagement holes 34 of the engagement piece 33 of the cover 31 respectively. Consequently, the connector is in the state of a provisional engagement wherein the covers 29, 30 are away from the housing 21 by a predetermined distance as shown in FIG. 6.

Since the covers 29, 30 are each away from the housing 21 in the above-described provisional engagement state, the main and branch cables 29, 30 are slightly held between the distal ends of the contact members 24 and the respective covers 29, 31. Thus, the main and branch cables 28, 30 are slidable relative to the housing 21 provisionally engaged with the covers 29, 30. Consequently, when slidably moved relative to the main cable 28, the housing 21 can be positioned so that the main cable 28 assumes a desired position.

Figure 7:
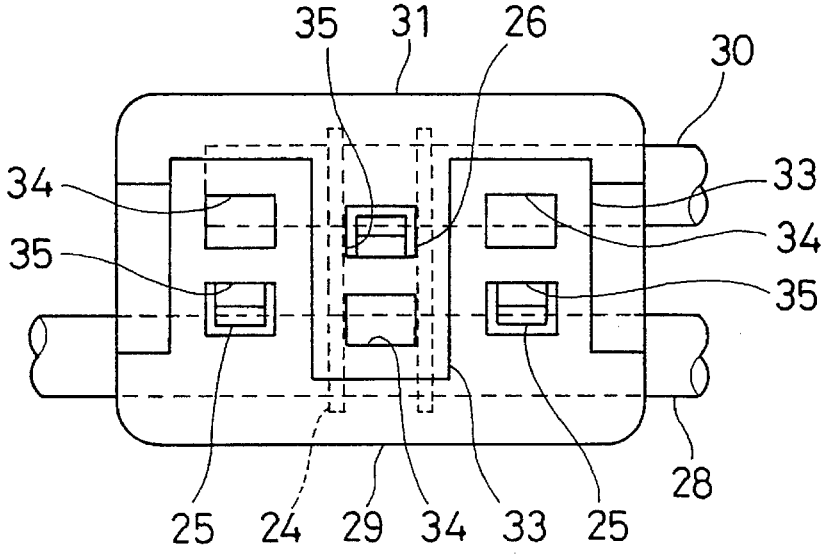
FIG. 7 side view of the connector in a complete engagement state.

After the housing 21 has been positioned relative to the main cable 28, the covers 29, 31 are pressed against the housing 21 with a tool such as pliers. With attachment of the covers 29, 31 to the housing 21, the first engagement holes 34 of the engagement pieces 33 of the covers 29, 31 are disengaged from the respective engagement projections 25, 26 of the housing 21. Subsequently, the second engagement holes 35 are engaged with the engagement projections 25, 26 respectively. Consequently, the covers 29, 31 are completely engaged with the housing 21 to be integrated therewith, as shown in FIG. 7. In this operation, the main and the branch cables 28, 30 are pressed hard against the contact members 24 by the cable receiving sections 32 of the covers 29, 31. The cable wires 28*a*, 30*a* of the main and branch cables 28, 30 are guided from the cutting portions 24*a* into the slits 24*b* of the contact members 24. Sheaths of the cable wires 28*a*, 30*a* are pressed and partially torn by the respective contact members 24 such that exposed wires are press fitted into the respective slits 24*b*. Consequently, the cable wires 28*a*, 30*a* are electrically connected by the contact members 24 and accordingly, the main and branch cables 28, 30 are electrically interconnected. The movement of the contact members 24 relative to the cable wires 28*a*, 30*a* is allowed by slits 36 formed to correspond to the contact members 24 respectively.

According to the above-described embodiment, the engagement projections 25, 26 are formed on the opposite sides of the housing 21. The first and second engagement holes 34, 35 are formed in the engagement pieces 33 of the respective covers 29, 31. In attachment to the housing 21, the covers 29, 31 are held in the provisional engagement state prior to the complete engagement. The covers 29, 31 are away from the housing 21 by the predetermined distance in the provisional engagement state. The housing 21 is slidably moved relative to the main cable 28 in the provisional engagement state, so that the housing 21 can be positioned relative to the main cable 28. In this state, the main and branch cables 28, 30 can be reliably interconnected by the contact members 24. Furthermore, since the covers 29, 31 and the housing 21 are integrated in the provisional engagement state, the housing 21 can be easily positioned relative to the main cable 28. In the prior art, however, the pressing members need to be pressed upon the positioning of the main cable relative to the housing. Thus, the connecting work can be performed with ease and reliability as compared with the prior art. Additionally, transverse movement of the main and branch cables 28, 31 are limited by the cutting portions 24*a* of the contact members 24 and the positioning grooves 32*a* of the cable receiving sections 32 of the respective covers 29, 31. Consequently, the covers 29, 31 can be attached to the housing 21 with further ease.

The wall 27 is formed on one end of the housing 21 and one end of the branch cable 30 is caused to abut against the wall 27 in the foregoing embodiment. Alternatively, the wall 27 may be eliminated and the middle portion of the branch cable 30 may be connected to the middle portion of the main cable 28.

Blades may be provided instead of the cutting portions 24*a* of the contact member 24 so that the sheaths of the main and branch cables 28, 31 are cut and torn by the blades. Although the contact members 24 are provided by way of the injection molding in the foregoing embodiment, they may be fitted with the housing 21, instead. The engagement projections 26 formed on the opposite sides of the housing 21 are located higher relative to the other engagement projections 25 in the foregoing embodiment. They may be located at the same height by changing the thickness of the housing 21, covers 29, 31, the length of each engagement piece 33, the positions of the first and second engagement holes 34, 35 and the like. Additionally, engagement pieces each having first and second engagement holes may be formed integrally with the housing 21 and each of the covers 29, 31 may be provided with engagement projections.

Figure 8:
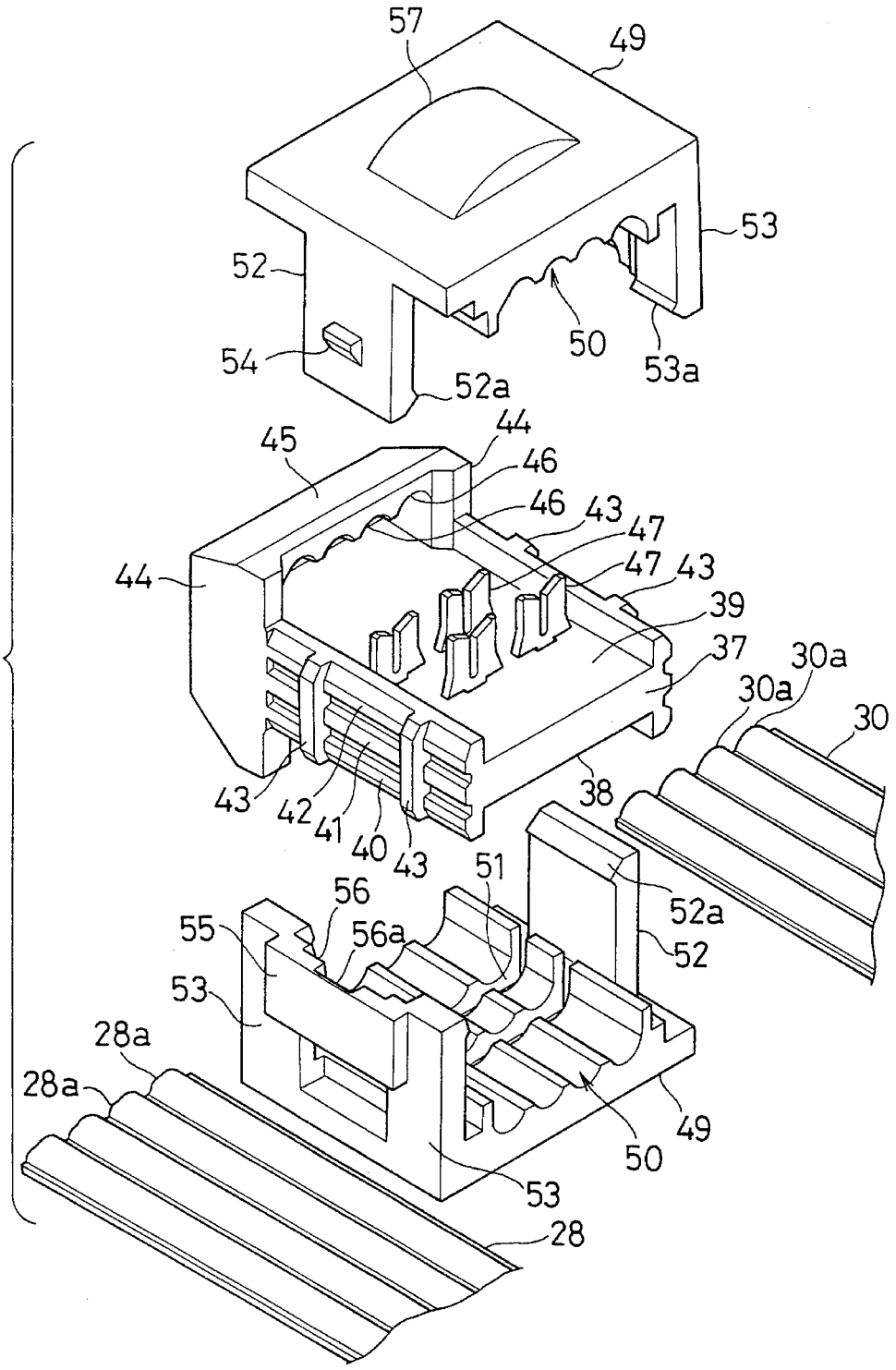
FIG. 8 is an exploded perspective view of a second embodiment of an electrical connector for interconnecting parallel multiconductor cables in accordance with the present invention.
Figure 9:
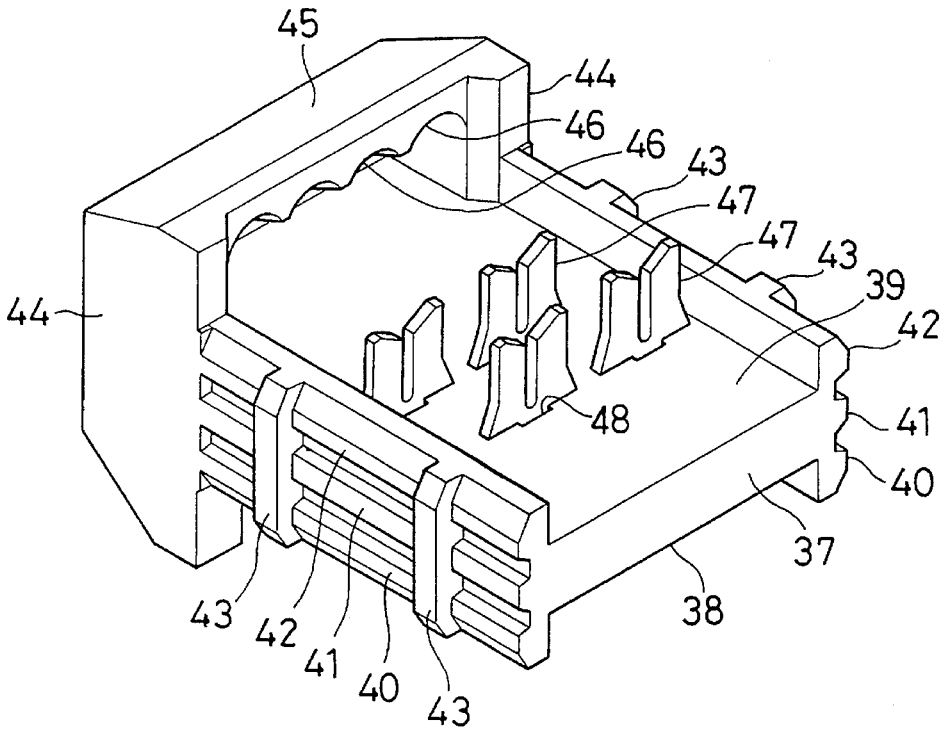
FIG. 9 is a perspective view of a housing.
Figure 10:
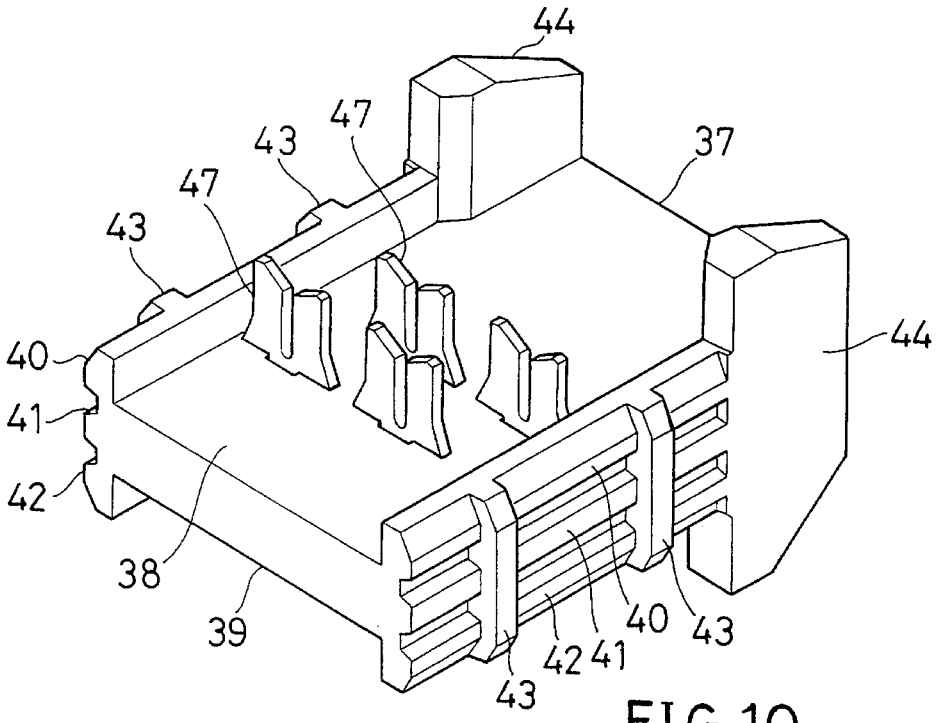
FIG. 10 is a perspective view of the housing showing the underside thereof.

FIGS. 8 to 24 illustrate a second embodiment of the invention. Referring to FIGS. 9 and 10, the housing 37 comprises the first and second cable receiving sections 38 and 39 formed to be opposite to each other, respectively. The housing 37 has finest, second and third ridges 40, 41 and 42 formed on each side of the housing 37 to extend transversely therealong with predetermined spaces. The housing 37 further has two guide portions 43 formed on each side thereof to extend across the ridges 40-42. Each guide portion 43 projects outwardly of each side of the housing 37.

Guide walls 44 are formed on ends of the side walls of the housing 37 to rise vertically from the first and second cable receiving sections 38, 29 respectively, as viewed in FIGS. 9 and 10. The two guide walls 44 rising from the second cable receiving section 39 are coupled by a cable guide 45 opposite to the second cable receiving section 39. The cable guide 45 has a cable receiving section 46 (see FIG. 21) opposite to the second cable receiving section 39 and inclined inwardly. The housing 37 is provided with a plurality of contact members 47.

Figure 11:
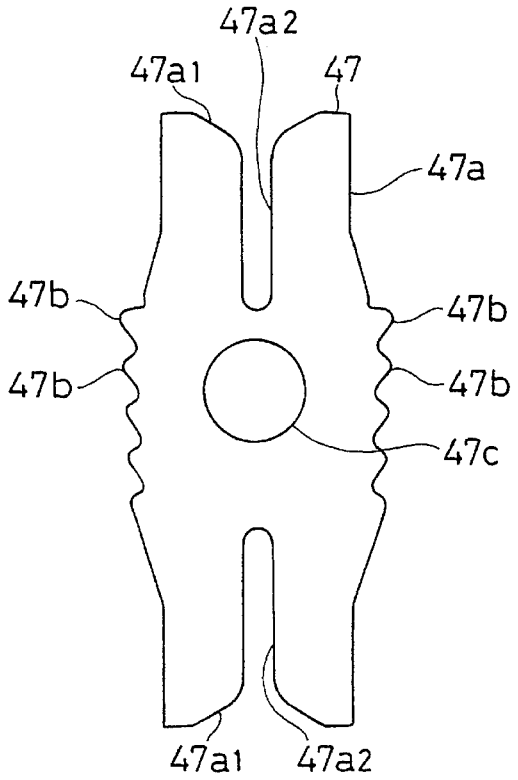
FIG. 11 is a front view of a contact member.
Figure 12:
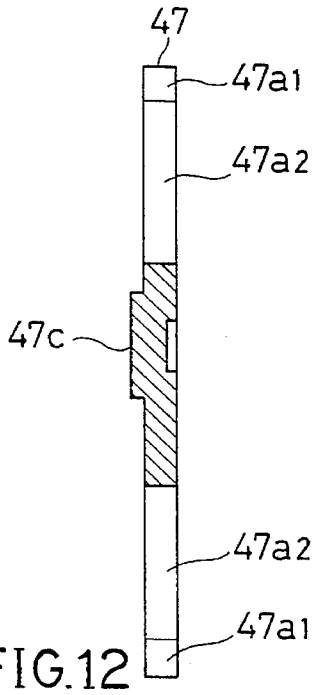
FIG. 12 is a longitudinally sectional view of the contact member.
Figure 13:
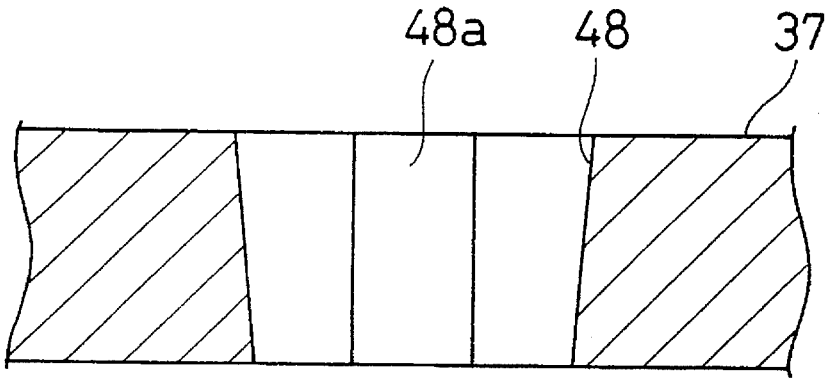
FIG. 13 is an enlarged partially sectional view of a housing.
Figure 14:
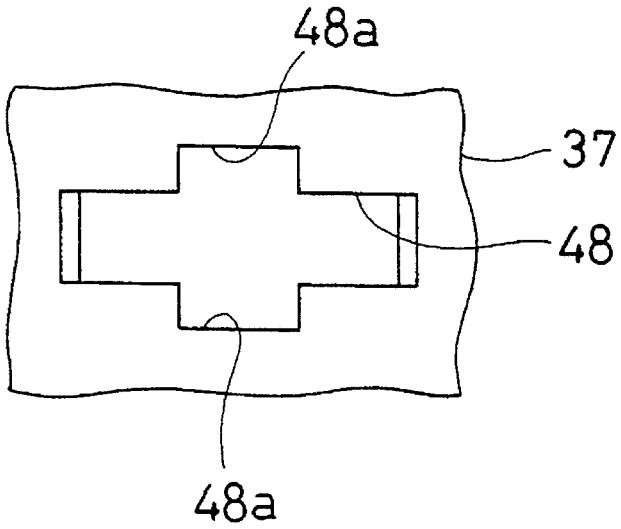
FIG. 14 is an enlarged partially plan view of the housing.

Referring to FIGS. 11 and 12, each contact member 47 has two terminal portions 47*a* formed in the upper and lower ends thereof respectively, as viewed in FIG. 11. Each terminal portion 47*a* has a V-shaped cutting portion 47*a*1 and a slit 47*a*2 contiguous to the cutting portion 47*a*1. Each contact member 47 has saw-toothed engagement teeth 47*b* formed on the central opposite sides thereof. Each contact member 47 further has a columnar convex portion 47*c* formed on its one side to be upwardly eccentric to the center or the center of gravity thereof. When mounted on the housing 37 by an automatic mounting machine, the contact members 47 are hung on the convex portions 47*c* thereof by the machine for the purpose of conveying the contact members. Since the convex portion 47*c* is eccentric to the center of the contact member 47, its self weight causes the same to turn by 180 degrees if the contact member 47 is hung on the convex portion 47*c* upside down by the automatic mounting machine, so that the contact members 47 are arranged in its normal row even when the contact members 47 are hung upside down by the mounting machine. The contact members 47 arranged by the automatic mounting machine are press fitted into attachment holes 48 formed in the housing 37. FIGS. 13 and 14 show one of the attachment holes 48. The attachment hole 48 includes small width portions into which the engagement teeth 47*b* are press fitted respectively. The attachment hole 48 further includes concave portions 48*a* into which the convex portions 47*c* are escaped respectively.

Figure 15:
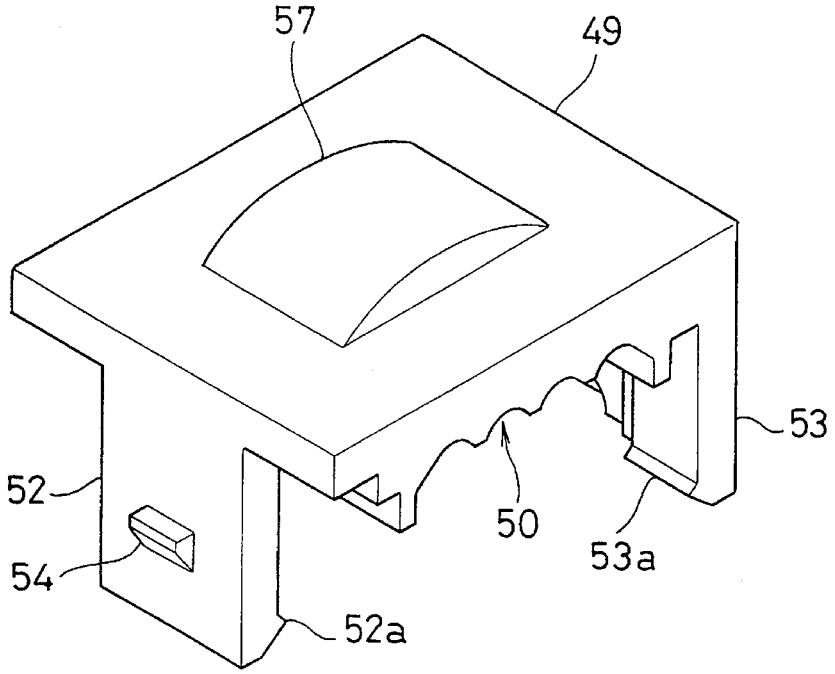
FIG. 15 is a perspective view of the connector housing showing the outside thereof.
Figure 16:
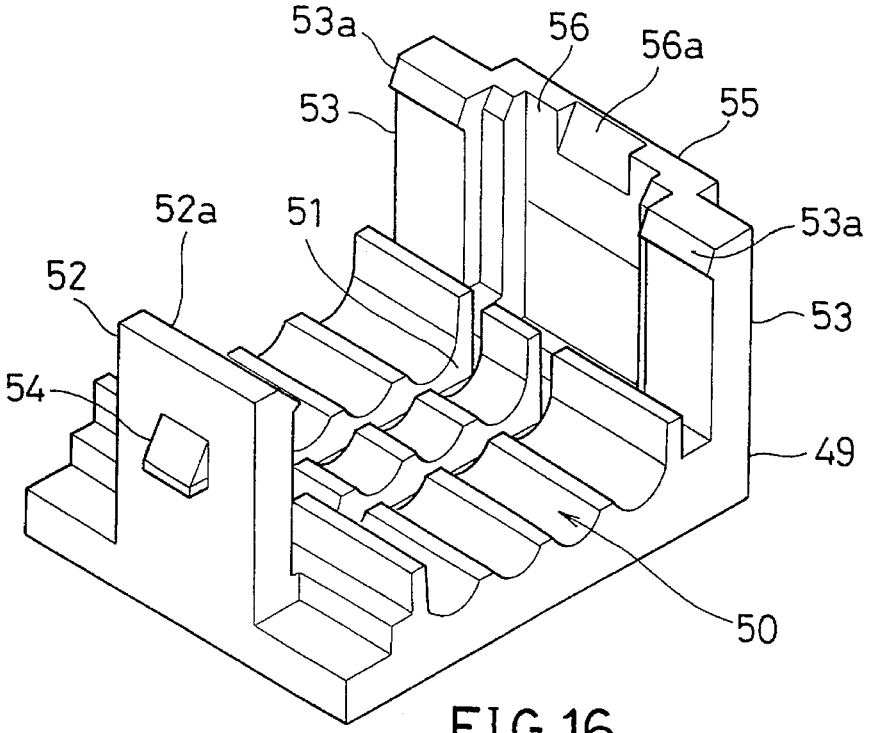
FIG. 16 is a perspective view of the housing showing the inside thereof.

Referring now to FIGS. 15 and 16, each cover 49 includes the cable receiving section 50 and grooves 51 extending across the cable receiving section 50. The contact members 47 can be inserted into the grooves 51. An engagement piece 52 projects from the central portion of one of opposite side ends of the cover 49. A pair of engagement pieces 53 are formed on the other side end of the cover 49. The engagement piece 52 has on the distal end an engagement claw 52*a* extending inwardly. Each engagement piece 53 also has on the distal end an engagement claw 53*a* extending inwardly. The engagement piece 52 further has on the middle outer face an engagement projection 54 extending outwardly. The engagement pieces 53 away from each other are coupled by an engagement wall 55. The engagement wall 55 has in the central inner face a concave portion 56 formed to correspond to the configuration of the engagement piece 52. The concave portion 56 has in its distal end an inclined face 56*a* formed to correspond to the configuration of the engagement projection 54. The cover 49 has a generally semicylindrical expanded portion 57 on the outer face thereof.

In the second embodiment, the engagement means is comprised of the engagement piece 52 and engagement projection 54 of each cover 49, the first to third ridges 40–42 and engagement wall 55 of the housing 37. The guide means is comprised of the engagement pieces 52, 53 of each cover 49 and the guide portions 43 and guide walls 44 of the housing 37.

The connection of the main and branch cable wires to the connector will be described. In a first attachment step, the main cable 28 is placed on the cable receiving section 50 of one of the covers 49, and the housing 37 is slightly thrust into the cover 49 from above with the guide portions 43 being slid on the engagement pieces 52, 53. Thrusting is interrupted when the engagement claws 52*a*, 53*a* of the engagement pieces 52, 53 of the cover 49 have been engaged with the first ridges 40 of the housing 37. Consequently, the cower 49 is away from the housing 37 by the predetermined distance. This state is referred to as a first provisional engagement state as shown in FIG. 8. In the first provisional engagement state, a gap is defined between the cable receiving section 50 of the cover 49 and the ends of the contact members 47 projecting from the first cable receiving section 38 of the housing 37. The gap has a larger diameter than each cable of the main cable 28. Accordingly, the housing 37 can be moved along the main cable 28.

Figure 21:
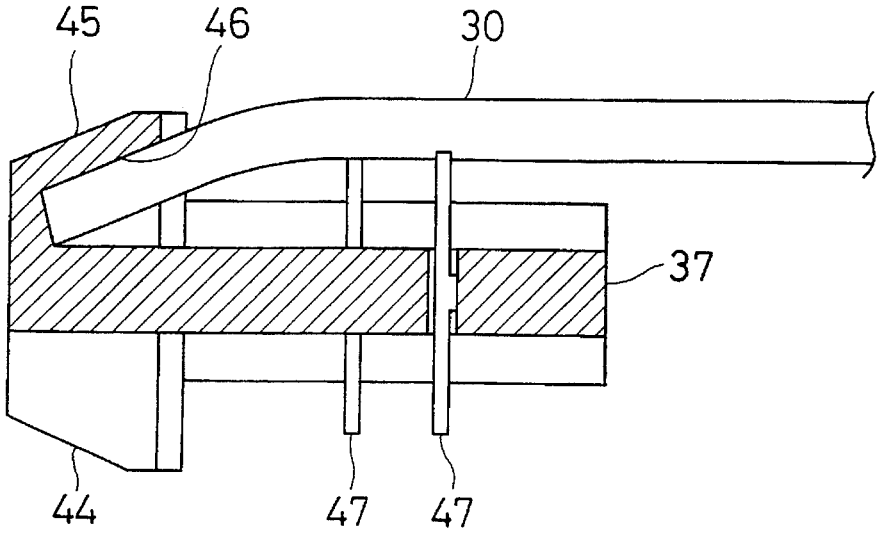
FIG. 21 is a longitudinally sectional side view of the housing with a branch cable held thereon.
Figure 22:
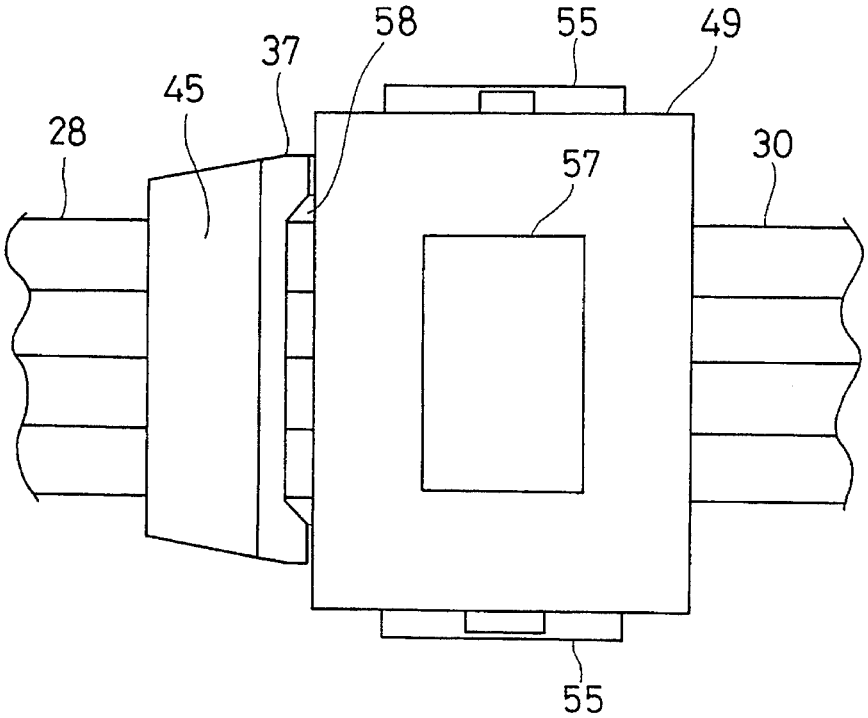
FIG. 22 is top plan view of the connector with the branch cable completely connected thereto.

Subsequently, the branch cable 30 is caused to pass over the contact members 47 projecting from the second cable receiving section 39 of the housing 37 and is then inserted into the cable receiving section 46 of the cable guide 45. The branch cable 30 having inserted into the cable receiving section 46 is placed on the contact members 47 by the self weight and held thereon, as shown in FIG. 21. Furthermore, the distal end of the branch cable 30 is bent downward along the cable receiving section 46. The elasticity causes the branch cable 30 to press against the cable receiving section 46 such that the branch cable 30 is held on the cable guide 45 and the contact members 47. Since the cable receiving section 46 is inclined inwardly, the branch cable 30 can be reliably held on the cable guide 45 even if it has a relatively smaller cable diameter. The other cover 49 is attached to the housing 37 from above to cover the second cable receiving section 39, and the engagement claws 52*a*, 53*a* of the engagement pieces 52, 53 of the cover 49 are engaged with the third ridges 42 of the housing 37. Consequently, the cover 49 is in the first engagement state wherein it is away from the housing 37 by the predetermined distance. The main and branch cables 28, 30 can be moved relative to the connector when each cover is in the first engagement state. Accordingly, the position of the connector relative to main and branch cables 28, 30 is adjusted.

Figure 19:
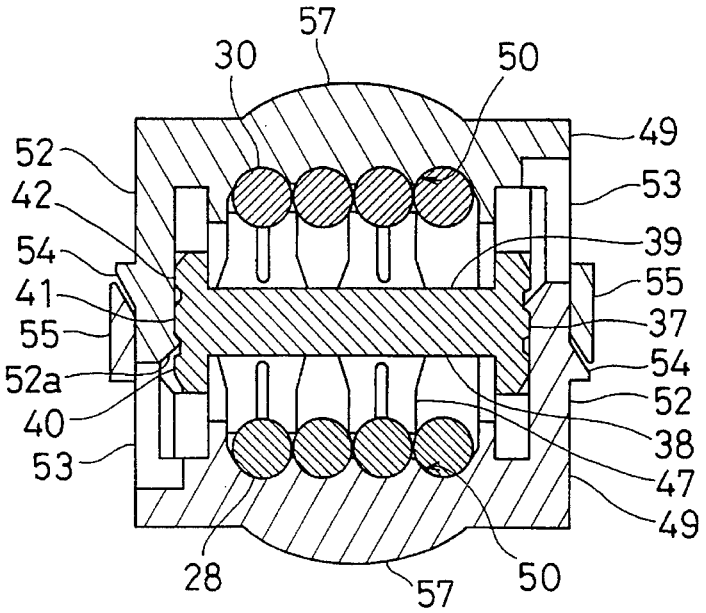
FIG. 19 is a longitudinal sectional view of the connector in a second provisional engagement state.

In a subsequent second attachment step, the covers 49 provisionally in engagement with the housing 37 are pressed hard to come near to each other. Then, the engagement piece 52 of each cover 49 invades the concave portion 56 of the engagement wall 55 of the counterpart cover 49 and the side of the housing 37, as shown in FIG. 19. Furthermore, the engagement claws 52*a*, 53*a* of the engagement pieces 52, 53 escape from the first and third ridges 40, 42 and then engage the second ridges 41 respectively. Since the engagement projection 54 of the engagement piece 52 of each cover 49 abuts against the inclined face of the engagement wall 55 of the counterpart cover 49, further movement of each cover 49 is prevented. Consequently, each cover 49 assumes a second provisional engagement state wherein each cover 49 is away from the housing 37 by a predetermined distance. In the second provisional engagement state, the gap between the cable receiving section 50 of each cover 49 and the end of the contact members 47 is set so as to be slightly smaller than the diameters of the main and branch cables 28, 30. Accordingly, the cutting portions 47*a* of the contact members 47 have slightly thrust into the main and branch cables 28, 30, whereby each cable 28, 30 is in a state of provisional fixation to the connector. Consequently, when the pressing against each cover 49 is released, the connector can be prevented from moving relative to the main cable 28 and the brain cable 30 can be prevented from falling out of the connector.

In the second provisional engagement state, a transversely extending window 58 is defined between the cable guide 45 of the housing 37 and the cover 49 by the guide walls 44 so as to be located to correspond to the distal end of the branch cable 30. The operator can look through the window 58 to see whether the branch cable 30 has been reliably held in the connector or not.

Figure 23:
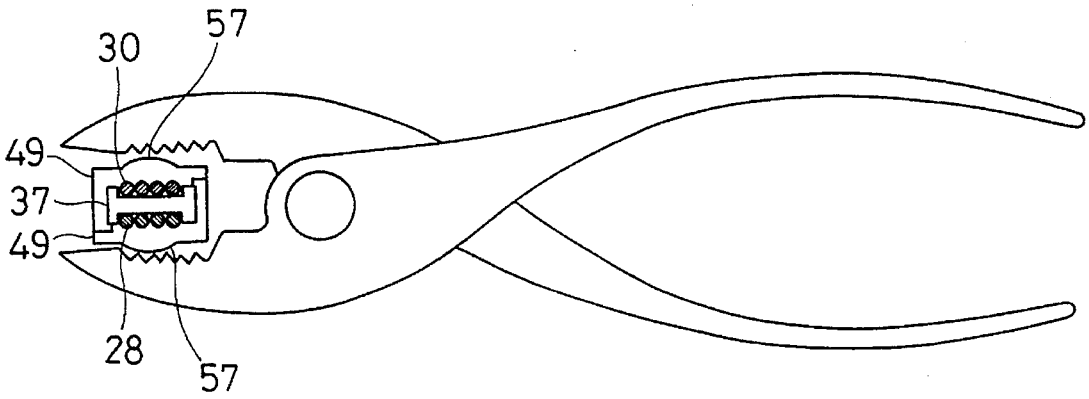
FIG. 23 is a front view of the connector clamped by a pair of pliers.

In a third or final attachment step, the covers 49 provisionally secured to the housing 37 are pressed with a tool such as pliers, as shown in FIG. 23. Since each cover 49 has the expanded portion 57 on the central outer face, pressing force applied to each cover 49 is received on the expanded portion 57 thereof. Accordingly, although large pressing force is usually applied to the central portion of each cover 49, it can be reliably attached to the housing 37. Furthermore, the engagement piece 52 of each cover 49 is guided in the state that it is held between the guide portions 43 of the housing 37. The engagement pieces 53 of each cover 49 hold the guide portion 43 therebetween and slide on the guide walls 44 when they are guided. Consequently, each cover 49 is guided only in the direction that it is attached to the housing.

Figure 20:
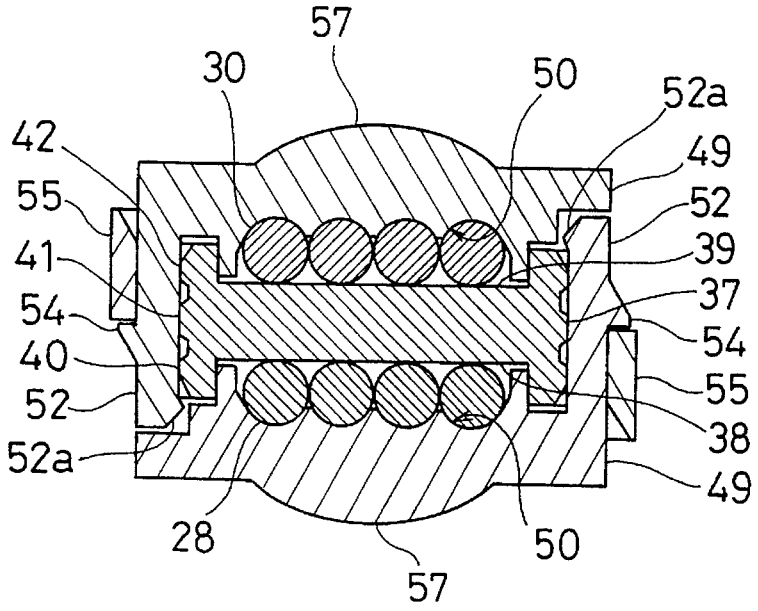
FIG. 20 is a longitudinal sectional view of the connector in a complete engagement state.

When having passed the engagement wall 55 of the counterpart cover 49, the engagement projection 54 of each cover 49 engages the end face of the engagement wall 55, and the claw 52*a* of the engagement piece 52 of each cover 49 engages the third or first ridge 40 or 42 which is farthest away therefrom, as shown in FIG. 20. Consequently, each cover 49 is secured in the state that it is attached to the housing 37. Since the main and branch cables 28, 30 are pressed against the cable receiving sections 50 of each cover 49 are held between the cutting portions 47*a*1 of the contact members 47. Then, the sheaths of the cables 28, 30 are torn by the cutting portions 47*a*1 of the contact members 47 and then, the inner conductors are press fitted into the slits 47*a*2, whereby the main and branch cables 28, 30 are interconnected.

Figure 17:
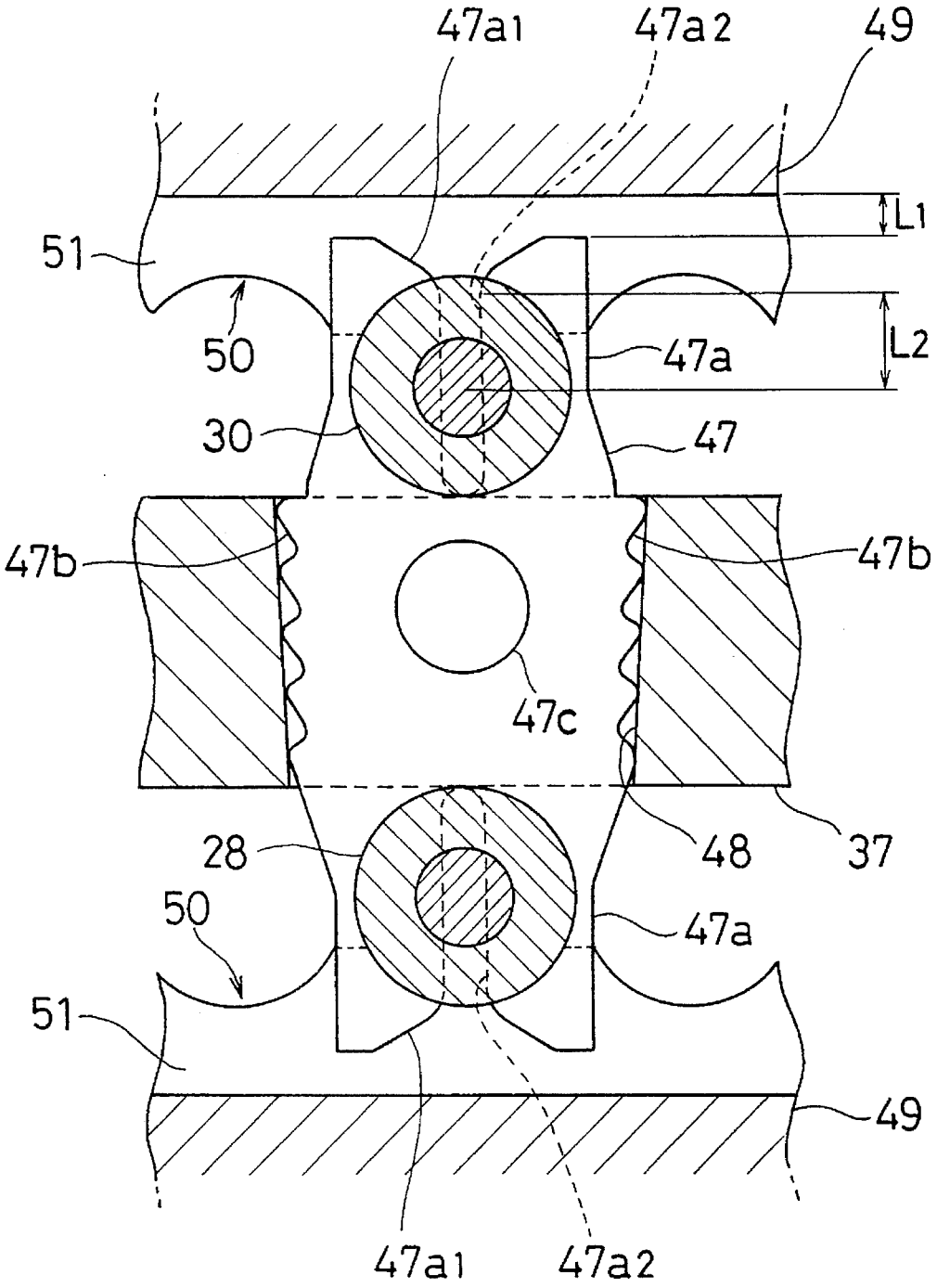
FIG. 17 is a longitudinal sectional view of the housing, the view helping understand arrangement of parts.
Figure 18:
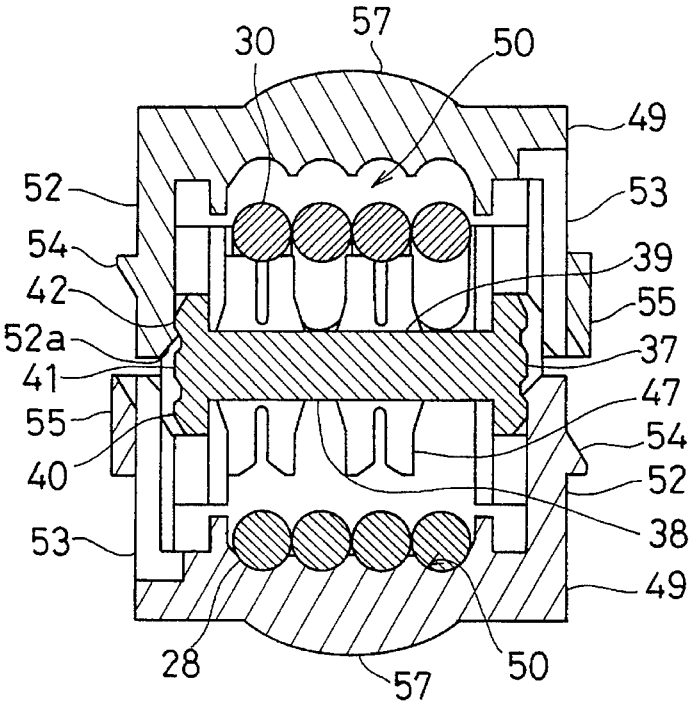
FIG. 18 is a longitudinal sectional view of the connector in a first provisional engagement state.

FIG. 17 illustrates the condition where the contact member 47 has been press fitted into the housing 37 and the covers 49 have been completely attached to the housing. In this condition, a part of each terminal portion 47*a* of the contact member 47 has invaded the groove 51 of the cover 49. The length L1 between the distal end of the terminal portion 47*a* of the contact member 47 and the bottom of the groove 51 of the cover is set to be smaller than the distance L2 that the cable 28 or 30 invades the slit 47*a*2 of the contact member 47.

According to the second embodiment, each cover 49 is held in the first provisional engagement state in the first attachment step. The main and branch cables 28, 30 are slidable relative to the connector in the first attachment step. Thereafter, each cover 49 is held in the second provisional engagement state in the second attachment step. The cables 28, 30 are provisionally secured to the connector in the second attachment step. Then, the cables 28, 30 are completely secured to the connector in the electrically conductive state in the third attachment step. As the result of the above-described three attachment steps, the cables 28, 30 can be positioned and attached to the connector easily and reliably.

The guide portions 43 and the guide walls 44 are provided on the sides of the housing 37. The engagement pieces 52, 53 of each cover 49 are guided along the guide portions 43 and the guide walls 44 when the covers 49 are attached to the housing 37. Consequently, the covers 49 can be reliably attached to the housing 37 without any inclination relative to the housing 37 even when the resistance force the main and branch cables 28, 30 receive from the contact members 47 is not uniform. Furthermore, since each cover 49 has the expanded portion 57 receiving the pressing force applied thereto, each cover 49 can be attached to the housing 37 with a general purpose tool such as the pliers. Consequently, specific jigs or tools are not necessitated and accordingly, the working efficiency can be improved. Furthermore, since the distal end of the branch cable 30 is held by the cable guide 45 of the housing 37, the branch cable 30 need not be held by hand so as not to move back when each cover 49 is attached to the housing 37. As a result, the working efficiency can be further improved.

Since the connector is connected across the main cable 28, a parallel multiconductor cable need to be used as the main cable 28. On the other hand, a cabtire cable extending out of a control device such as an address unit is sometimes used as the branch cable 30. Positioning the parallel multiconductor cable relative to the housing 37 is easy because it comprises a plurality of cables integrated. However, when the cabtire cable is used as the branch cable 30, it is difficult to hold all the cables of the cabtire cable by hand because they are separated from one another.

In the second embodiment, however, the distal end of the branch cable 30 is held by the cable guide 45. Accordingly, the branch cable 30 can be easily held by the cable guide 45 even when the cabtire cable is used as the branch cable 30. Moreover, the branch cable 30 can be reliably held by the cable guide 45 even when the number of cables of the branch cable 30 is smaller than that of cables of the main branch 28. Consequently, a variety of types of cables can be used as the branch cable 30.

The window 58 is defined in the connector when the covers 49 have been attached to the housing 37. Since the position of the distal end of the branch cable held by the cable guide 45 can be checked through the window 58, the branch cable 30 can be reliably connected to the connector.

Figure 24:
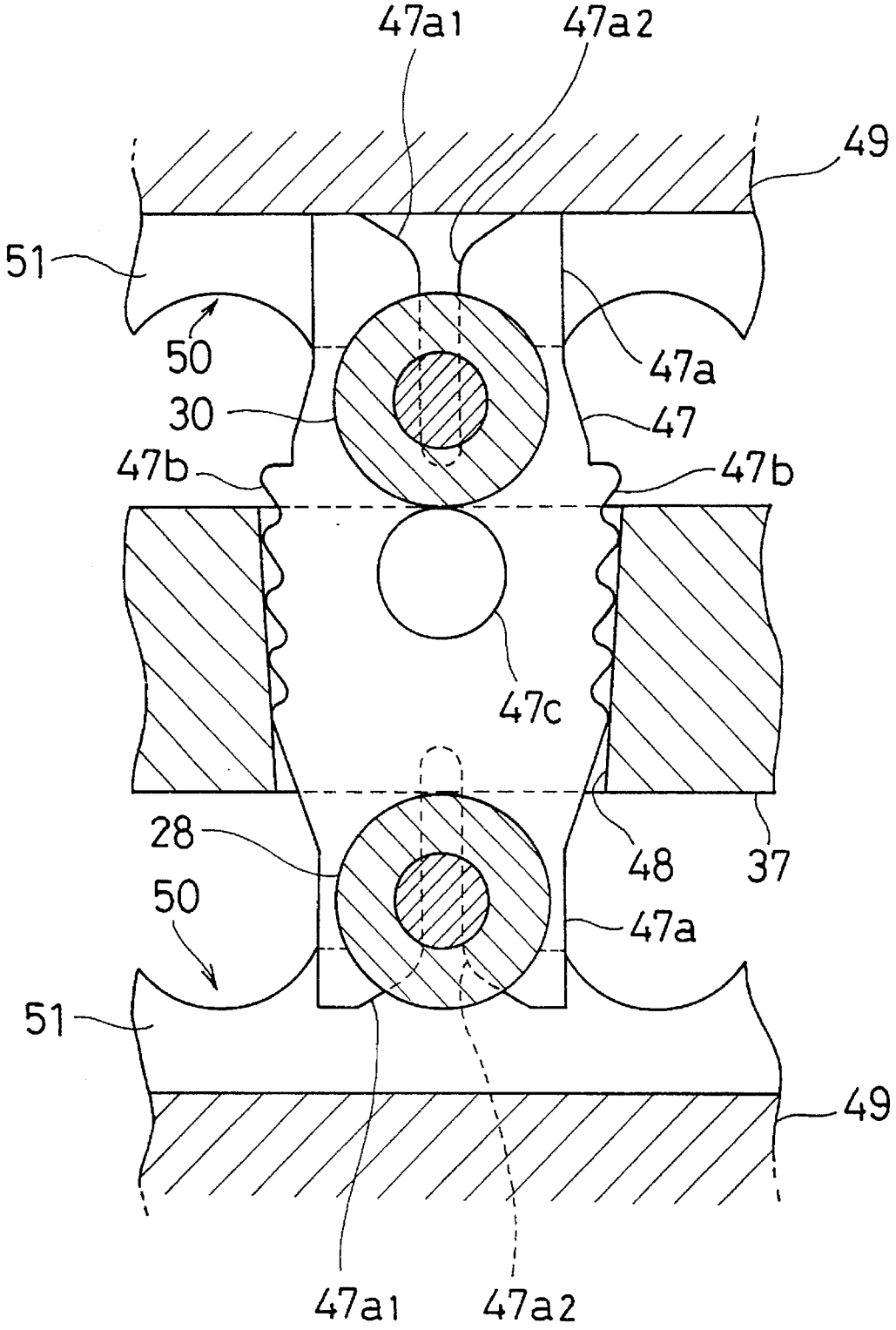
FIG. 24 is an enlarged longitudinal sectional view of the housing, showing the condition that the contact member is out of position.

A difference may arise between the pressing force of the main cable 28 and that of the branch cable 30 when the main and branch cables 28, 30 are crimped to the terminal portions 47*a* of the contact members 47. In such a case, force would act on one or more contact members 47, causing them to move in the direction in which they fall out of the housing 37, as shown in FIG. 24. In the second embodiment, however, the length L1 between the distal end of the terminal portion 47*a* of the contact member 47 and the bottom of the groove 51 of the cover 49 is set to be smaller than the distance L2 that the cable 28 or 30 invades the slit 47*a*2 of the contact member 47. Accordingly, if the contact member 47 moves in the direction that it falls out of the housing 37, the distance that the branch cable 30 is press fitted into the slits 47*a*2 of the contact member 47 to be thereby crimped thereto is shortened by the distance L1. Consequently, the branch cable 30 crimped to the slit 47*a*2 of the terminal portion 47*a* can be prevented from getting out of place.

Figure 25:
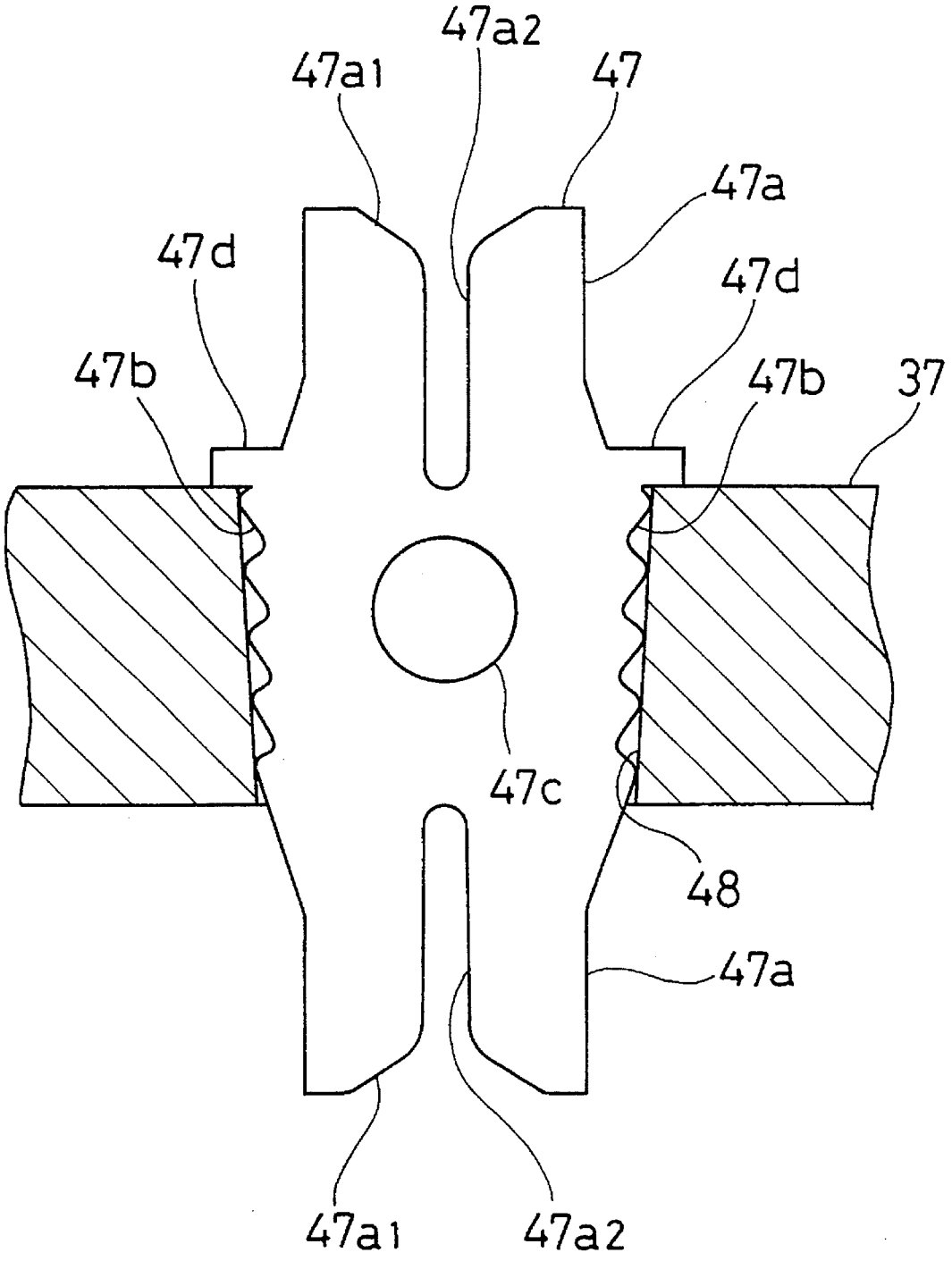
FIG. 25 is an enlarged front view of a contact member employed in a modified form of the connector of the second embodiment.

FIG. 25 illustrates a modified form of the contact member 47. In the modified form, the contact member 47 has two protrusions 47*d* formed above the top engagement teeth 47*b* on opposite sides thereof respectively. When the contact member 47 has been press fitted into the attachment hole 48, the protrusions 47*d* are engaged with the peripheral edge of the attachment hole 48 so that the contact member 47 is prevented from further moving in the direction that it is press fitted into the attachment hole 48. Consequently, only the gap between the contact members 47 and one of the covers 49 disposed at the side opposite to the protrusions 47*d* need to be controlled. That is, in the construction as shown in FIG. 17, the contact members 47 having press fitted into the housing 37 may move in both directions. Accordingly, the gaps between each end of the contact members 47 and each cover 49 need to be controlled. However, in the above-described modified form, only the gap between one end of each contact member 47 and one end of the cover 49 located at the side opposite to the protrusions 47*d* need to be controlled.

The contact member press fitted into the housing 37 can be positioned by the protrusions 47*d* with high precision in the modified form. Consequently, no specific machine need not be employed for positioning the contact members 47 relative to the housing 37.

The convex portion 47*c* of the contact member 47 may be eliminated. The engagement tooth 47*b* of the contact member 47 may be changed into another contour.

FIGS. 26 to 34 illustrate a third embodiment of the invention. In the third embodiment, the connector connects the main and branch cables so that they intersect each other.

Figure 27:
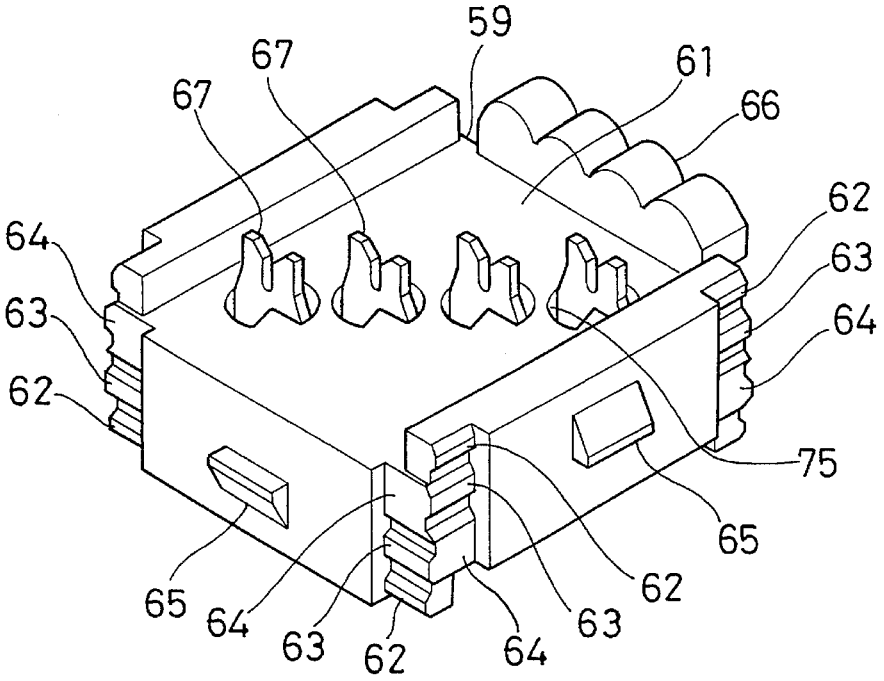
FIG. 27 is a perspective view of a housing showing the outside thereof.
Figure 28:
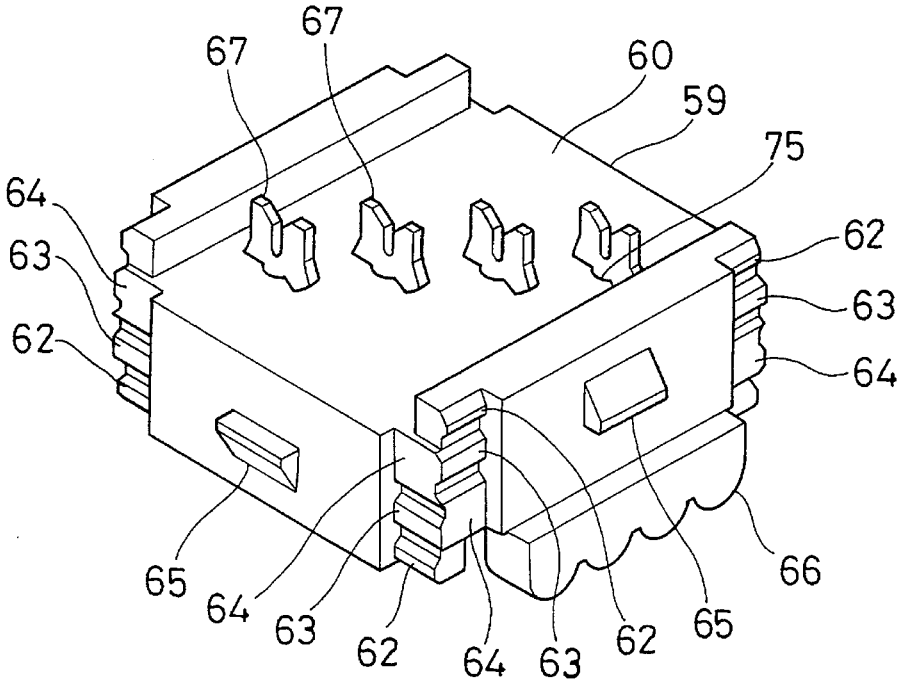
FIG. 28 is a perspective view of the housing showing the inside thereof.

FIGS. 27 and 28 show the upper side and underside of the housing 59 of the connector respectively. The housing 59 is formed generally into the shape of a square block and has first and second cable receiving sections 60 and 61 in the underside and the upper side respectively. The first, second and third ridges 62, 63 and 64 each serving as the engagement means are formed on both ends of the opposite sides of the housing 59. Engagement protrusions 65 each serving as the engagement means are formed on the central portions of each side of the housing 59. A wall 66 is formed on one end of the second cable receiving section 61. The contact members 67 each formed of a flat plate of a copper alloy are disposed along a diagonal of each cable receiving section 60, 61 in a twisted state, as will be described in detail later.

Figure 29:
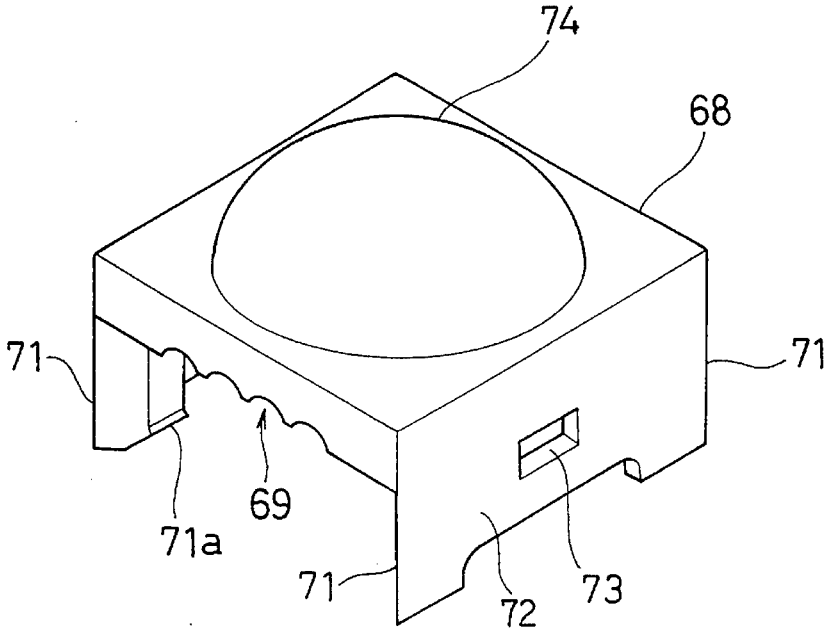
FIG. 29 is a perspective view of the cover showing the outside thereof.
Figure 30:
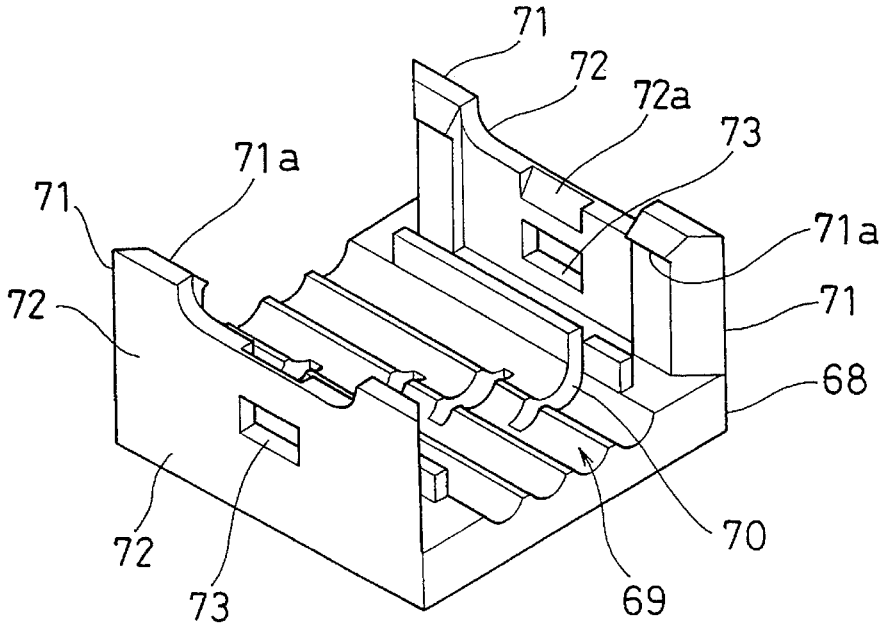
FIG. 30 is a perspective view of the cover showing the inside thereof.

Referring now to FIGS. 29 and 30, the cover 68 has a cable receiving section 69 formed in the inside thereof. The cable receiving section 69 has slits 70 formed along a diagonal thereof so that the ends of the contact members 67 are allowed to invade them. Engagement legs 71 each serving as engagement means are formed on four corners of the cover 68. Each engagement leg 71 has an engagement claw 71*a* formed on a distal end thereof to extend inwardly. The engagement legs 71 at a pair of opposite sides are coupled by an engagement wall 72 extending along the cable receiving section 69. Each engagement wall 72 has a central engagement hole 73 and an inclined face 72*a* formed in the central distal end thereof. The cover 68 has on its outer face a semicircular expanded portion 74.

Figure 31:
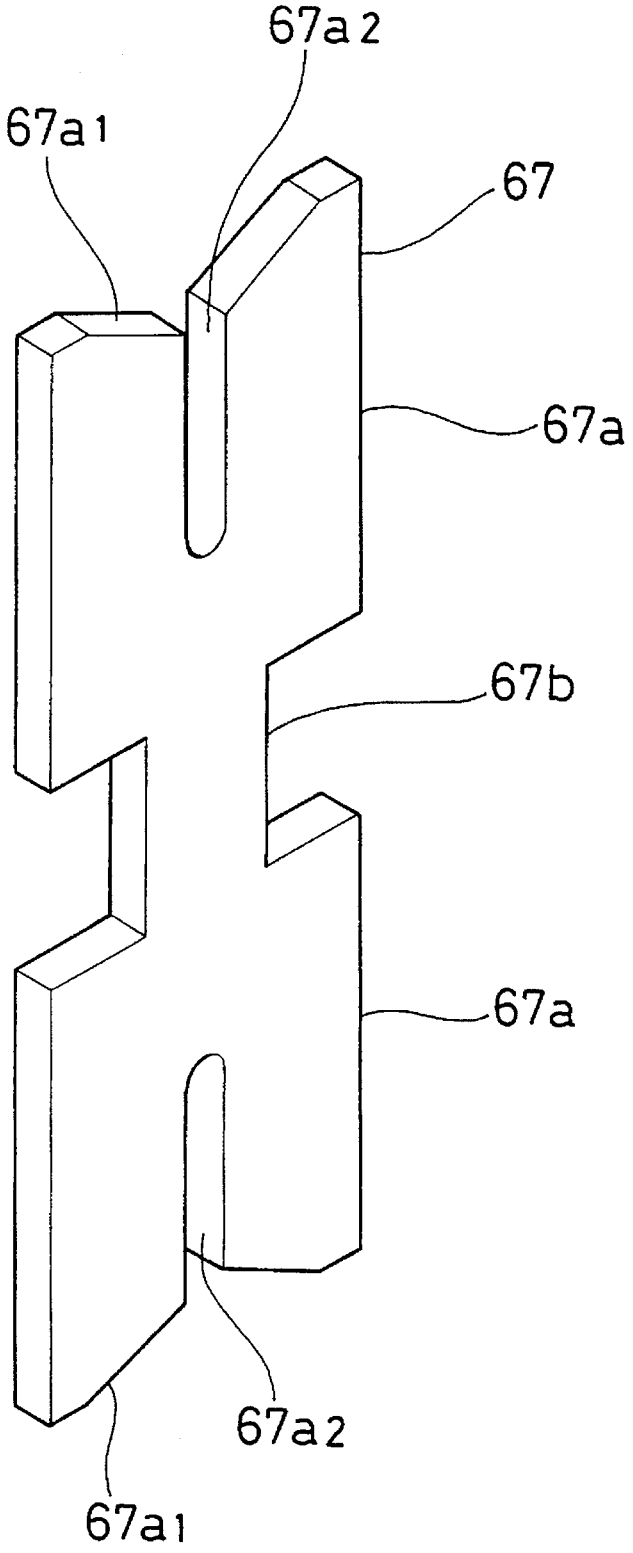
FIG. 31 is an enlarged perspective view of the contact member.

Structure for attaching the contact members 67 to the housing 59 will be described. Referring to FIG. 31, the contact member 67 comprises a pair of terminal portions 67*a* with a larger width and a connecting portion 67*b* having a smaller width and connecting the terminal portions 67*a*. Each terminal portion 67*a* includes a V-shaped cutting portion 67*a*1 and a slit portion 67*a*2 contiguous with the cutting portion 67*a*1.

Figure 32:
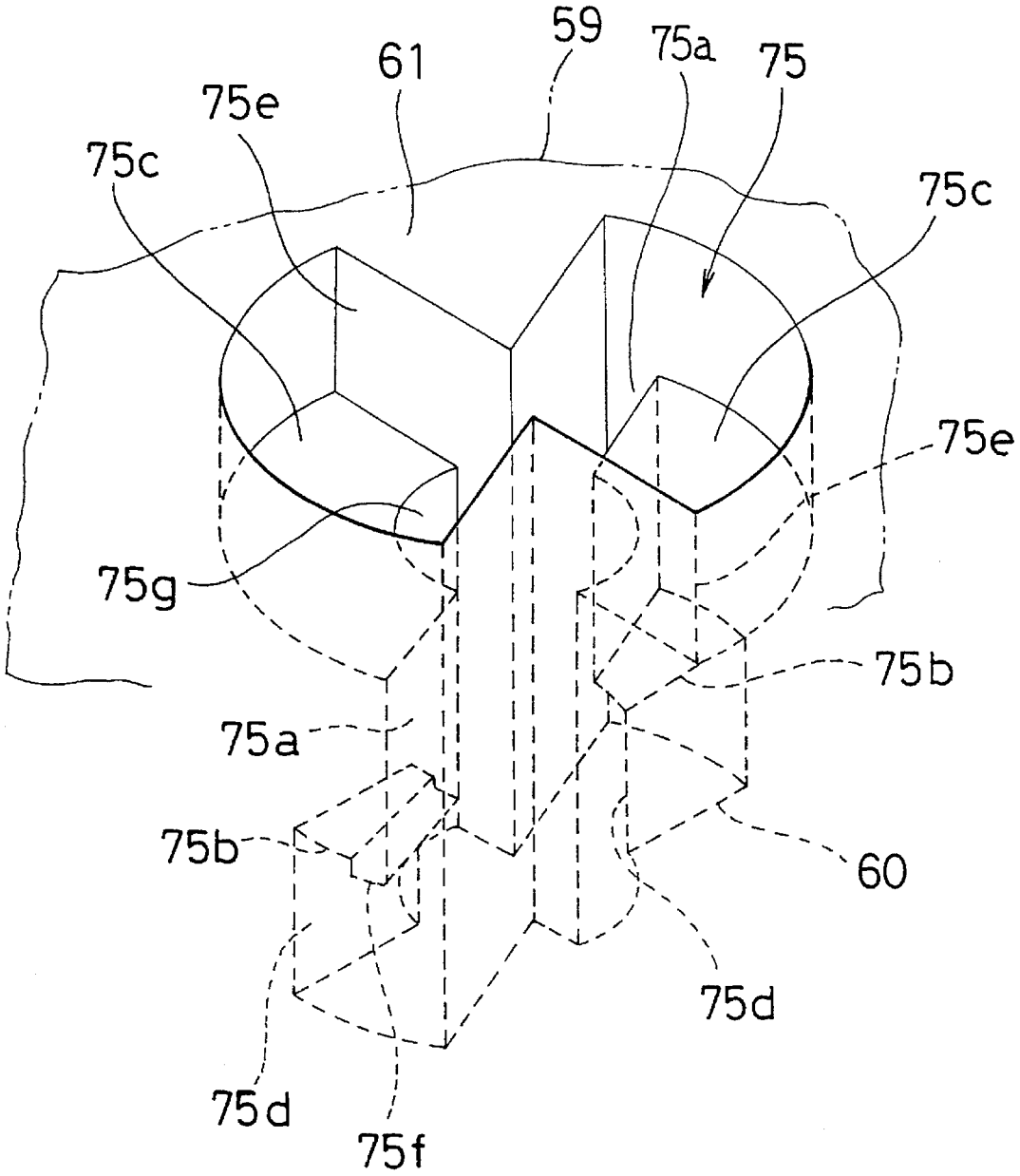
FIG. 32 is an enlarged perspective view of a mounting section formed in the housing for mounting the contact member.

Referring to FIG. 32, the housing 59 has an attachment portion 75 including a cylindrical through hole 75*g* extending through the housing 59 and having a diameter approximately equal to the width of the connecting portion 67*b* of the contact member 67. The attachment portion 75 further has a pair of first receiving faces 75b formed on the first cable receiving section 60 to be opposite to each other about the hole 75*g* and a pair of second receiving faces 75*c* formed on the second cable receiving section 61 to be opposite to each other about the hole 75*g*. Each first receiving face 75*b* and each second receiving face 75*c* are opposite to each other axially of the hole 75*g*. The first and second receiving faces 75*b*, 75*c* are formed to be depressed from the first and second cable receiving sections 60, 61 about the hole 75*g* into a sectorial shape. Each first receiving face 75*b* has a central angle of approximately 40 degrees and each second receiving face 75*c* has a central angle of approximately 130 degrees. A pair of slits 75*a* are formed to be opposite about the hole 75*g* and to be depressed outwardly. A pair of convex portions 75*f* serving as holding means are formed on edges of the slits 75*a* contiguous with the first receiving faces 75*b* respectively. The first receiving face 75*b* has on its end a vertical, first engagement wall 75*d*. The second receiving face 75*c* also has on its end a vertical, second engagement wall 75*e*. An axial distance between the top of the convex portion 75*f* and the second receiving face 75*c* is set to be approximately equal to the length of the connecting portion 67*b* of the contact member 67. An axial distance between the first and second receiving faces 75*b*, 75*c* is set to be slightly shorter than the length of the connecting portion 67*b* of the contact member 67, for example, 0.3 mm.

Figure 33C:
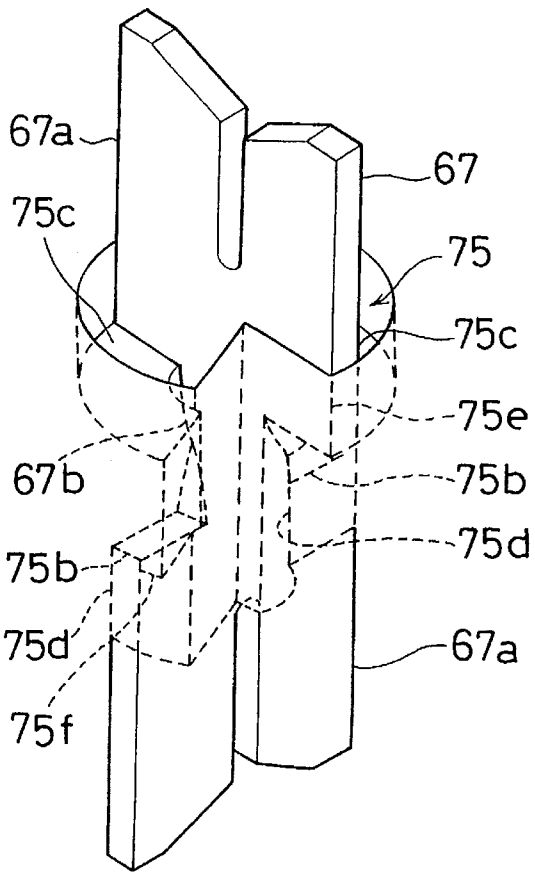
FIGS. 33A to 33C are perspective views of the mounting section showing a manner of mounting the contact member in the mounting section.
Figure 33B:
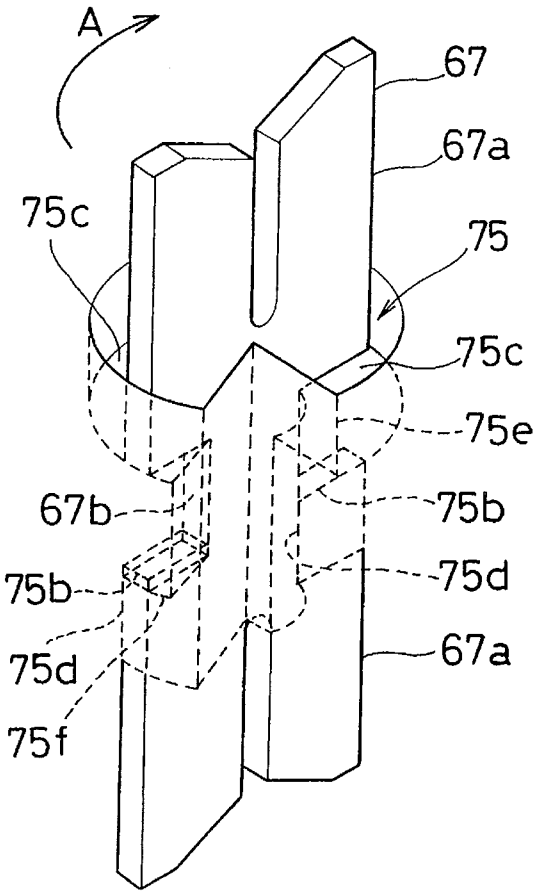
Figure 33A:
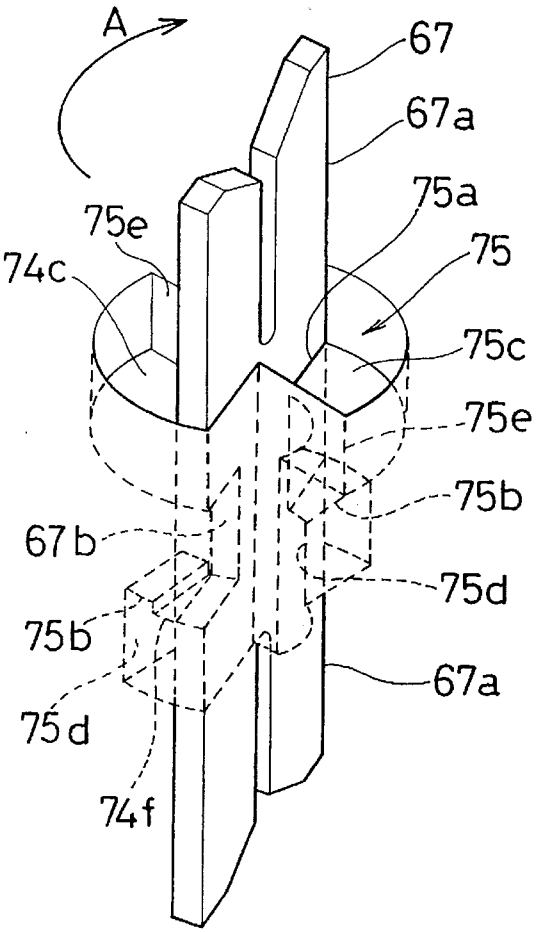
Figure 34C:
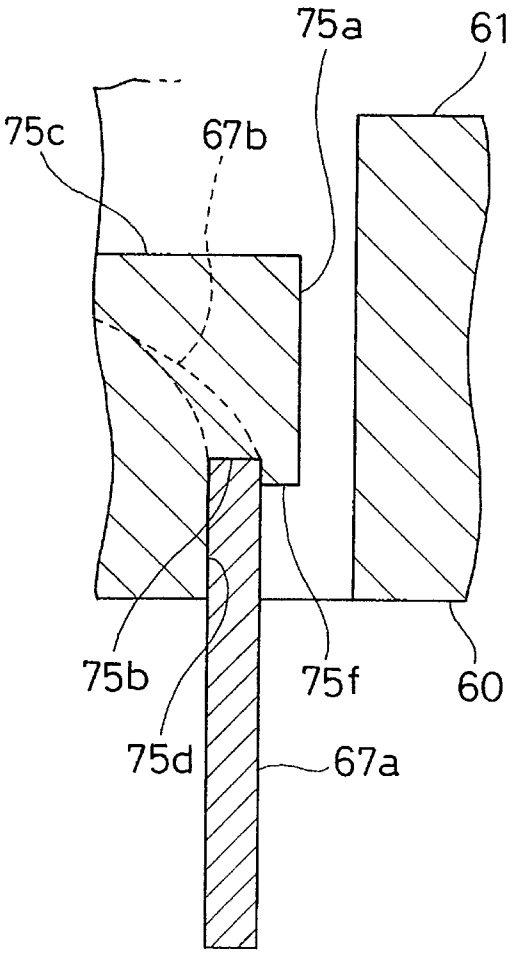
FIGS. 34A to 34C are enlarged sectional views of the mounting section showing the manner of mounting the contact member in the mounting section.
Figure 34B:
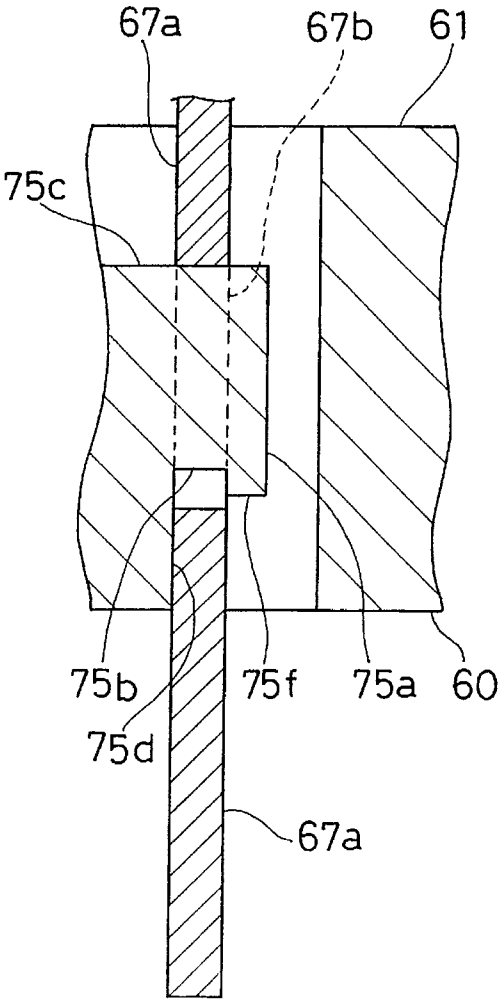
Figure 34A:
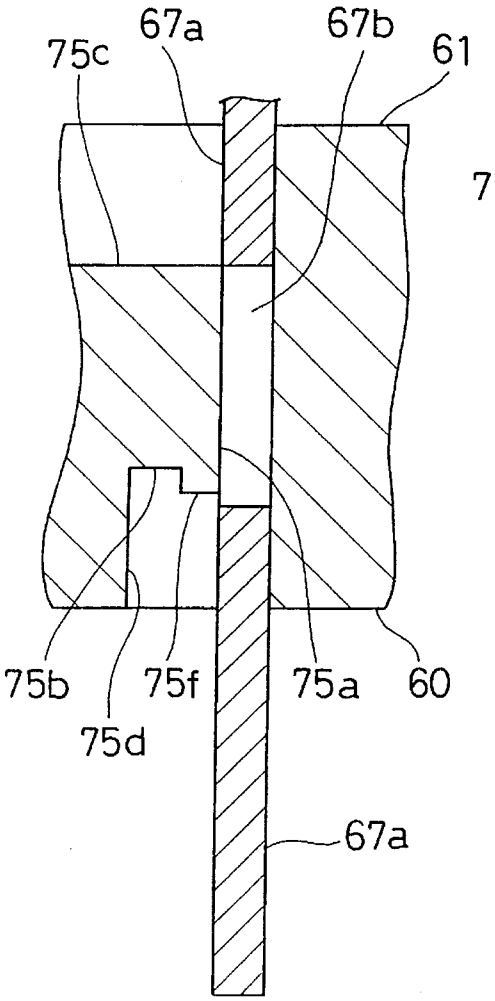

Attachment of the contact member 67 to the attachment portion 75 will be described. First, the contact member 67 is inserted into the hole 75*a*, as shown in FIG. 33A, so that the connecting portion 67*b* thereof is located in the hole 75*a*, as shown in FIG. 34A. Then, one of the terminal portions 67*a* of the contact member 67 projecting from the second cable receiving section 61 is twisted in the direction of arrow A in FIG. 33B, whereupon the other terminal portion 67*a* of the contact member 67 gets over the convex portion 75*f* of the first receiving face 75*b* to thereby abut against the first engagement wall 75*d*, as shown in FIG. 34B. When further twisted in the direction of arrow A until a total twist angle of 90 degrees is reached, said one terminal 67*a* passes over the second receiving face 75*c* with said other terminal portion 67*a* engaged with the first engagement wall 75*d*, thereby abutting against the second engagement wall 75*e* to be engaged therewith, as shown in FIG. 33C. When said one terminal portion 67*a* is twisted in the condition that said other terminal portion 67*a* is in engagement with the first engagement wall 75*d*, force applied to the contact member 67 concentrates upon the narrow connecting portion 67*b*. Accordingly, the connecting portion 67*b* is twisted in the cylindrical hole 75*g* such that the length thereof and accordingly, the gap between each terminal portion 67*a* and the adjacent one are shortened. Consequently, the terminal portion 67*a* in engagement with the first engagement wall 75*d* over the convex portion 75*f* of the first receiving face 75*b* is held between the first engagement wall 75*d* and the convex portion 75*f*, as shown in FIG. 34C. Thus, each terminal portion 67*a* in engagement with the first and second engagement walls 75*d*, 75*f* can be prevented from being rotated in the direction opposite arrow A when the contact member 67 has inserted into the hole 75*a* and completely twisted. The contact members 67 are thus attached to the respective attachment portions 75 in the manner as described above. As the result of the above-described attachment, the cutting edges of the terminal portions 67*a* on the respective first and second cable receiving sections 60, 61 intersect each other.

Figure 26:
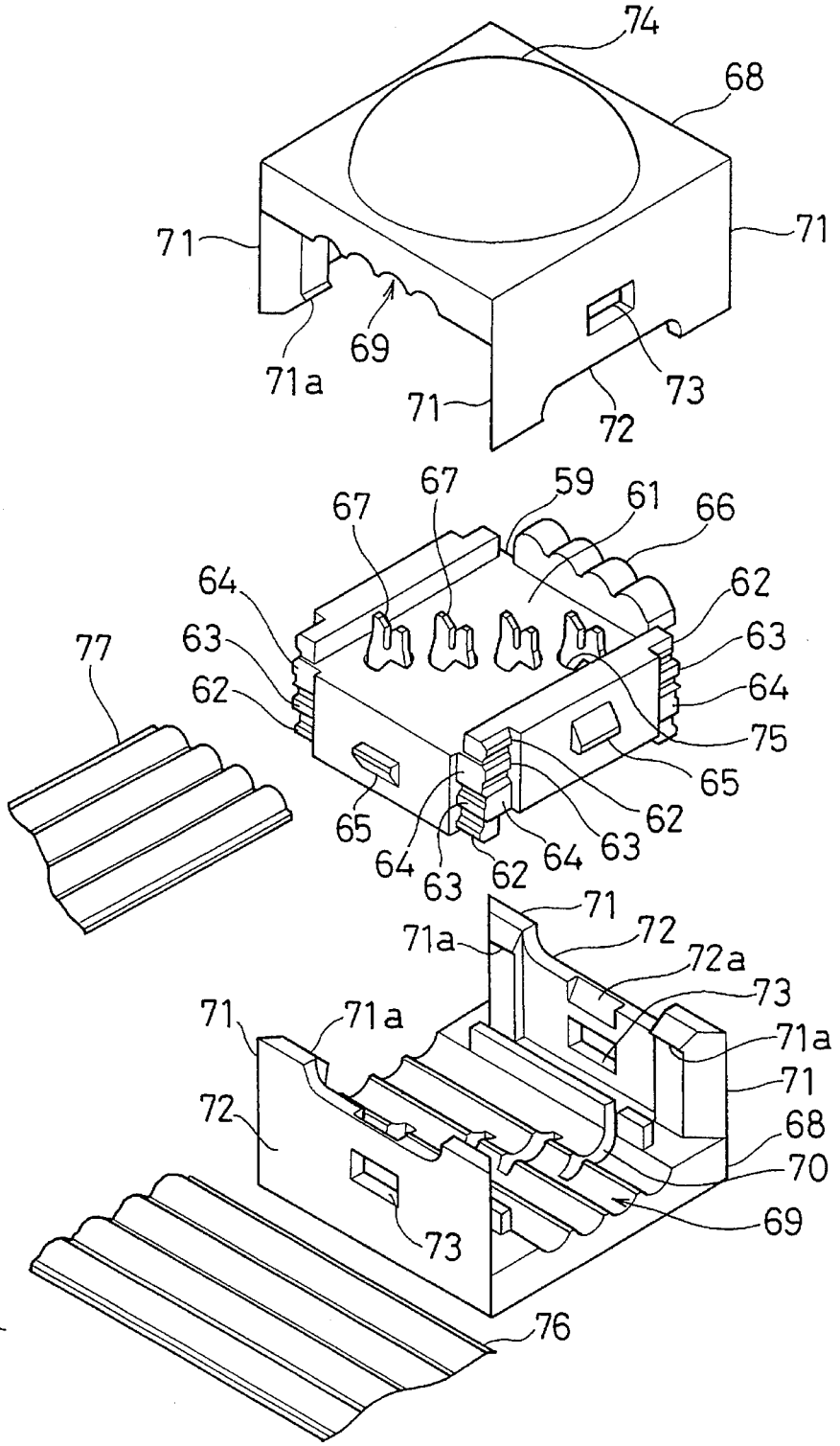
FIG. 26 an exploded perspective view of a third embodiment of an electrical connector in accordance with the present invention.

In interconnecting the main and branch cables 76, 77 as shown in FIG. 26, the main and branch cables 76, 77 are held between the first and second cable receiving sections 60, 61 and the cable receiving sections 69 of the covers 68, respectively. In this state, the cover 68 is thrust into the housing 59. Then, the engagement claws 71*a* of the legs 71 of the covers 68 engage the first ridges 62 of the housing 59. This state is referred to as a first provisional engagement state. The positional relations between the main and branch cables 76, 77 and the connector can be adjusted in the first provisional engagement state.

The engagement claws 71*a* of the legs 71 of the covers 68 engage the second ridges 63 when the covers are further thrust. This state is referred to as a second provisional engagement state. The main and branch cables 76, 77 can be provisionally fixed to the connector in the second provisional engagement state. Then, when the covers 68 are further thrust into the housing 59, the engagement claws 71*a* of the legs 71 get over the third ridges 64, and the engagement holes 73 are engaged with engagement protrusions 65 of the housing 59 respectively. Consequently, the covers 68 can be secured to the housing 59. The main and branch cables 76, 77 are thus interconnected in the state that they intersect each other.

According to the third embodiment, the attachment portions 75 are formed along the diagonal of each of the first and second cable receiving sections 60, 61 of the housing 59. The contact members 67 are attached to the respective attachment portions 75 so that the central axes of both ends of the terminal portions 67*a* of each contact member 67 are on the same axis. As the result of such locational relation as described above, the same covers 68 can be used as those secured to the first and second cable receiving sections 60, 61, the number of parts can be reduced as compared with the conventional construction in which the contact members are attached to the housing by way of the injection molding or fitting. Consequently, the manufacturing and controlling costs of the parts can be reduced. Furthermore, since the types of the covers need not be identified in attachment of them to the housing 59, the working efficiency can be improved.

Since each contact member 67 is twisted for the attachment to the housing 59, a space occupied by each contact member 67 attached to the housing 59 is quite small. Consequently, the housing 59 can be rendered small.

The terminal portions 67*a* of the contact members 67 are held at both sides by the engagement walls 75*d*, 75*e* respectively when engaged with them. The component of large force is applied to each terminal portion 67*a* so that it is bent when the main and branch cables 76, 77 are press fitted into the same. However, the force can be received by the first and second engagement walls 75*d*, 75*e* . Consequently, the contact members 67 can be prevented from buckling and deformation.

Figure 35B:
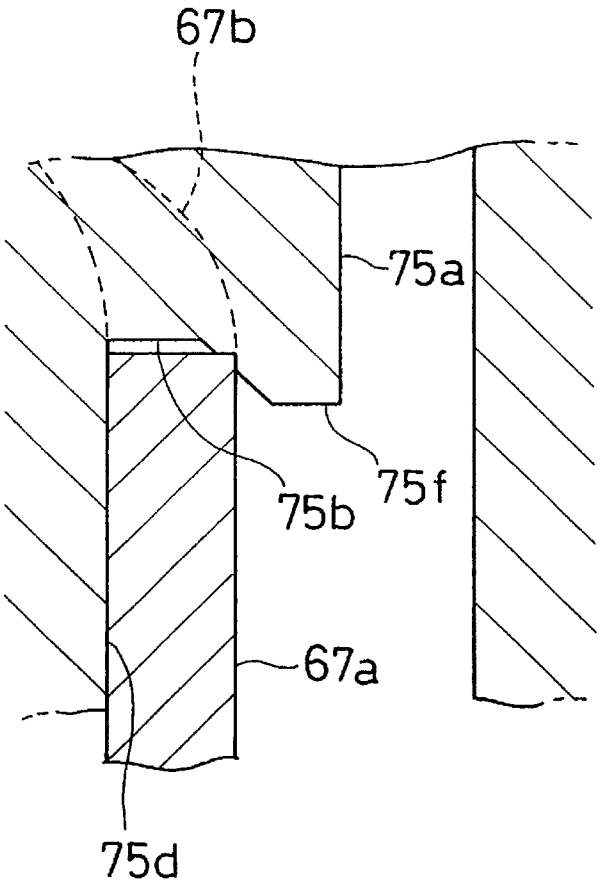
FIGS. 35A and 35B are sectional views of the mounting section in a modified form of the connector of the third embodiment.
Figure 35A:
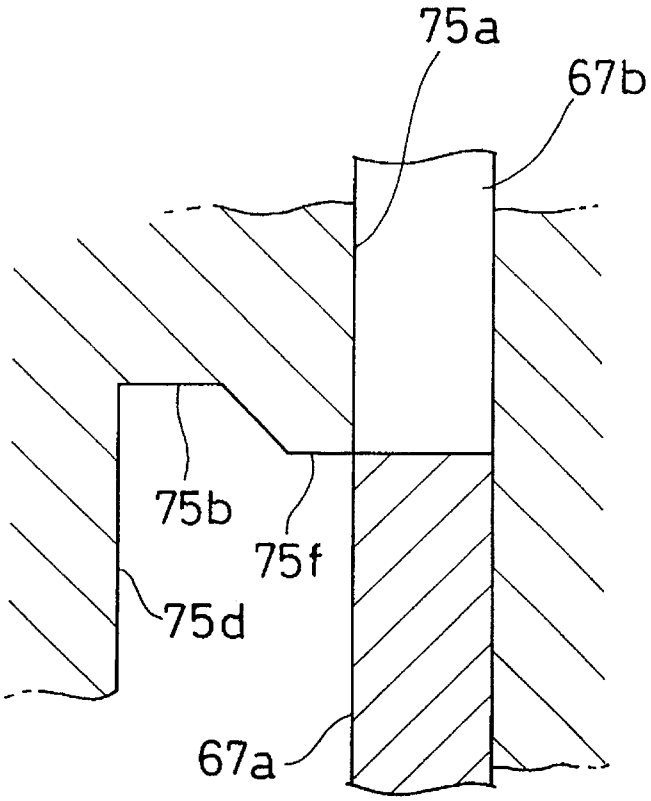

The convex portion 75*f* formed on the first receiving face 75*b* of each attachment portion 75 may be modified as shown in FIGS. 35A and 35B. As shown in FIG. 35A, the face between the top thereof and the first receiving face 75*b* is inclined. The terminal portion 67*a* thrusts into the convex portion 75*f* more securely when having been completely twisted, as shown in FIG. 35B. Accordingly, each contact member 67 can be positioned more reliably.

Figure 36:
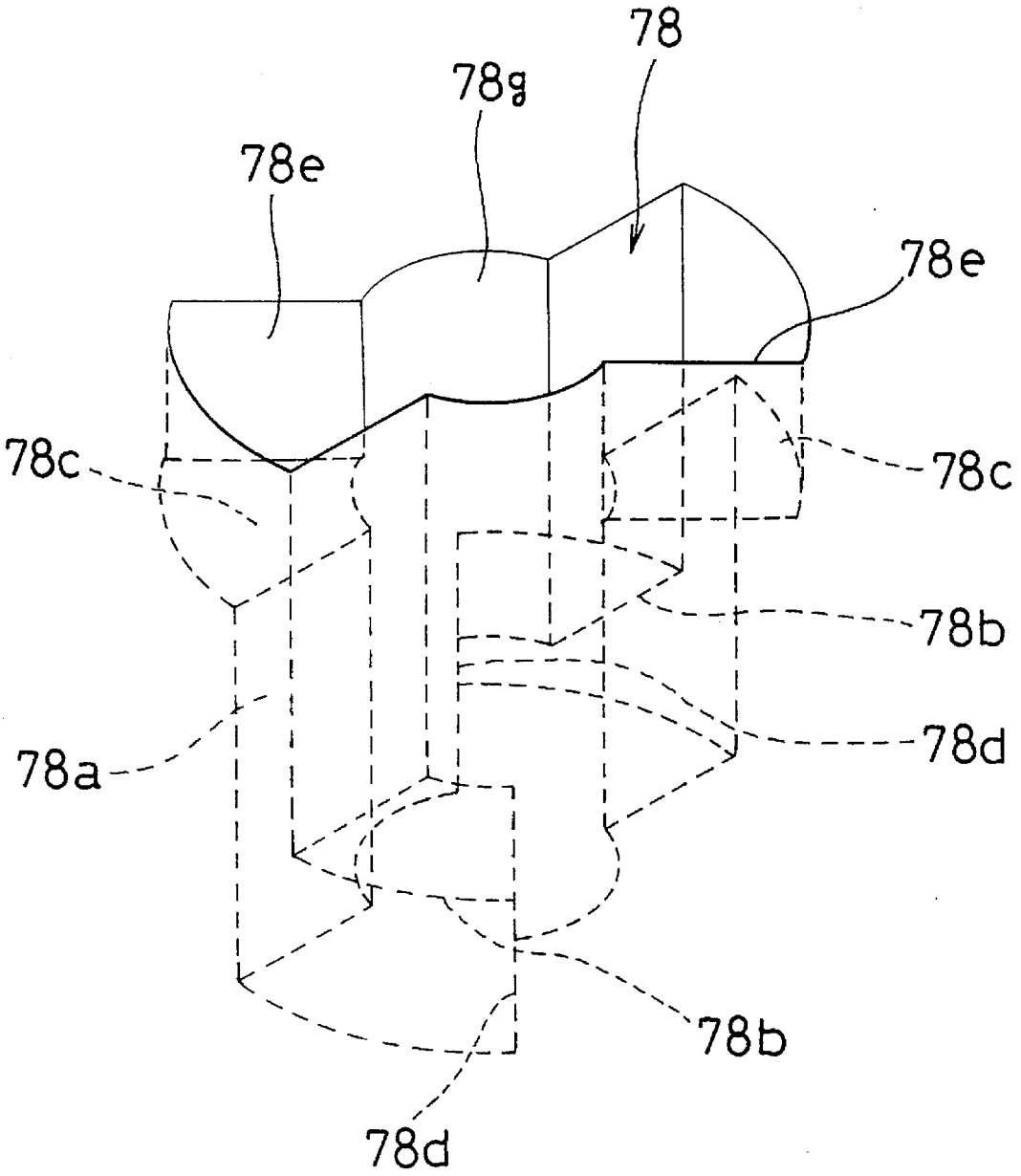
FIG. 36 is a perspective view of the mounting section of a fourth embodiment of an electrical connector in accordance with the present invention.
Figure 37A:
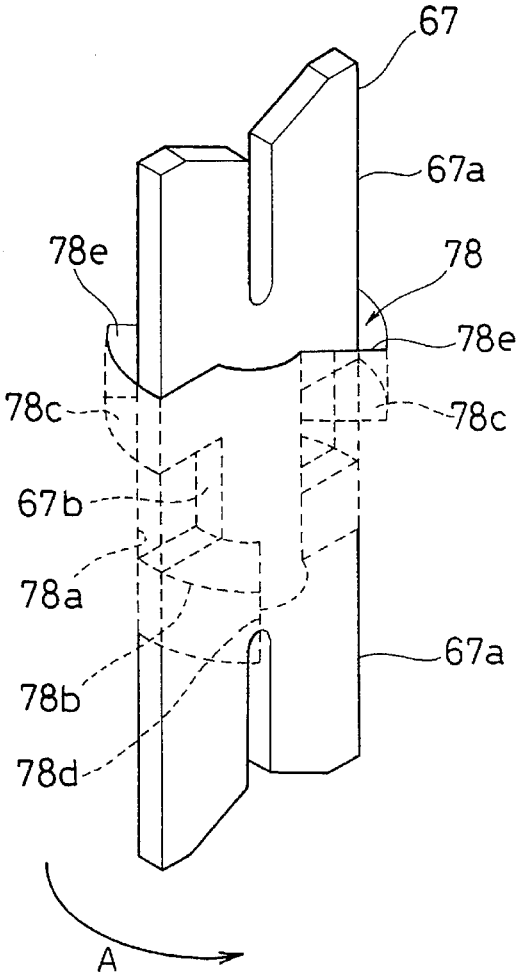
FIGS. 37A and 37B are perspective views of the mounting section showing a manner of mounting the contact member in the mounting section.
Figure 37B:
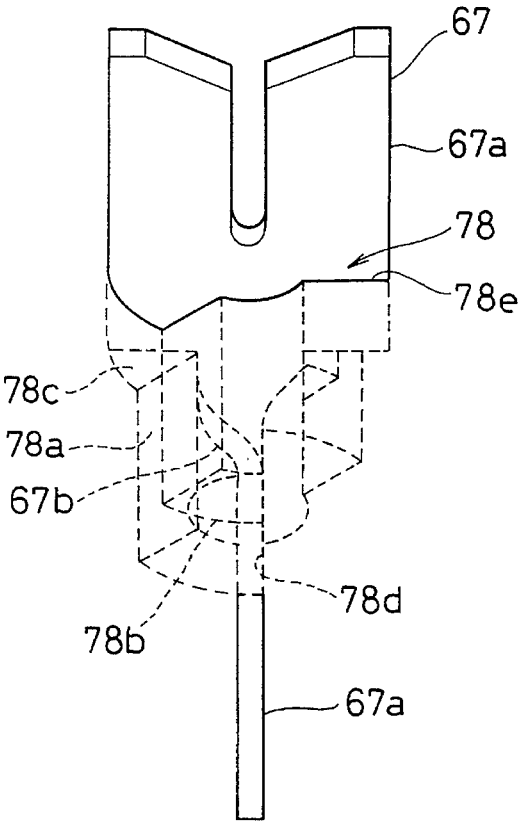
Figure 38:
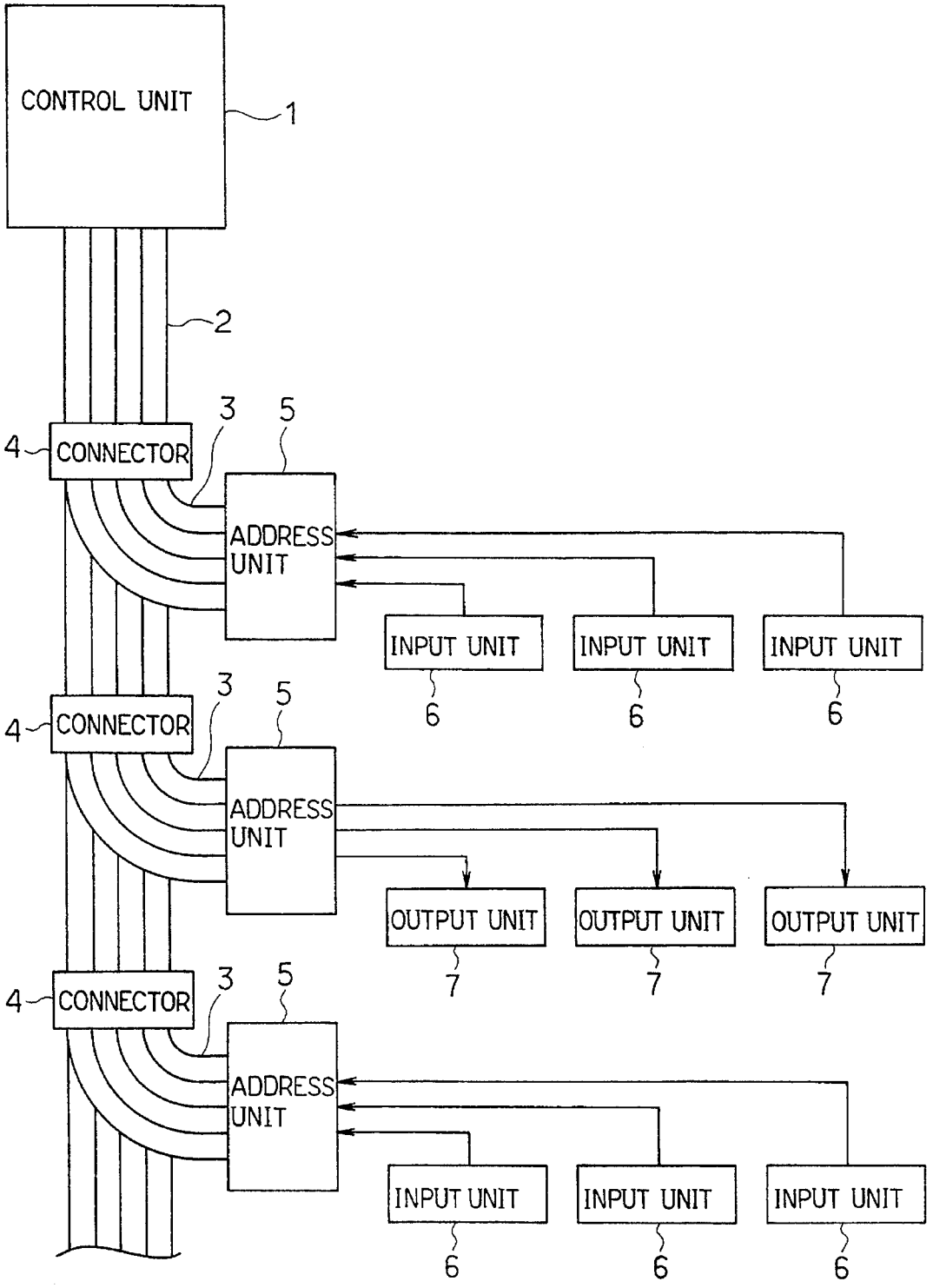
FIG. 38 PRIOR ART
FIG. 38 is a diagrammatic view showing connection between a control unit, and input and output units in a prior art arrangement.
Figure 39:
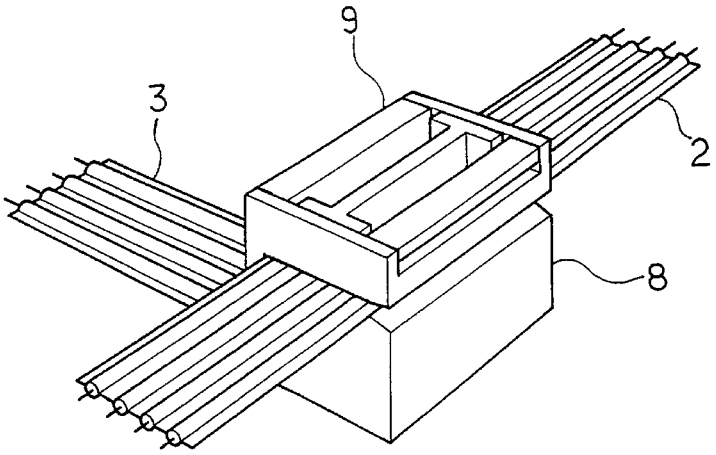
FIG.39 PRIOR ART
FIG. 39 is a perspective view of an electrical connector in another prior art arrangement, showing the state that main and branch cables are connected to the connector.
Figure 40:
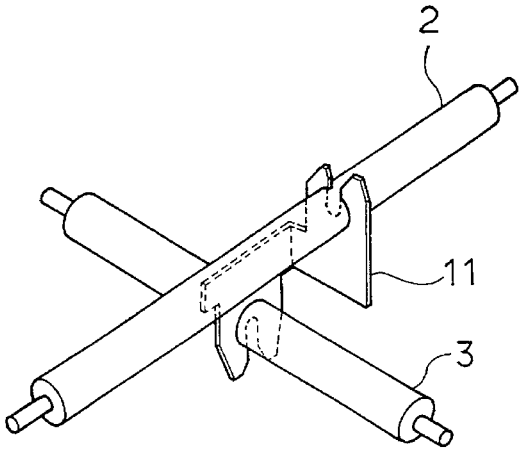
FIG.40 PRIOR ART
FIG. 40 is a perspective view of a contact member in the state that the main and branch cables are connected to the connector.
Figure 41:
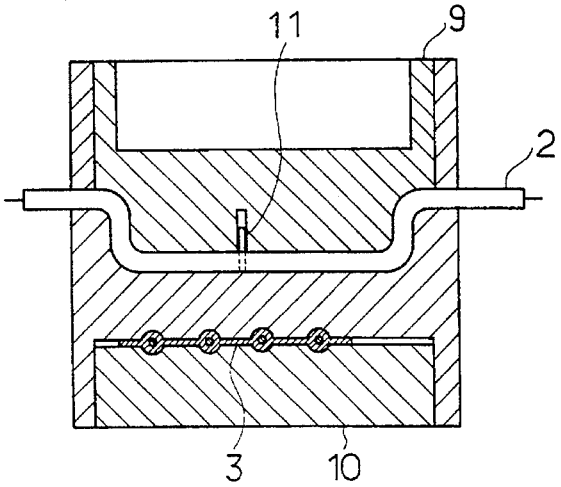
FIG.41 PRIOR ART
FIG. 41 is a longitudinal sectional view of the connector in its assembled state.

FIGS. 36, 37A and 37B illustrate a fourth embodiment of the invention. In the fourth embodiment, the construction shown in FIG. 36 differs from that of FIG. 32 only in that each first receiving face 78*b* and each second receiving face 78*c* are not opposite to each other axially of the hole 78*g* while each first receiving face 75*b* and each second receiving face 75*c* are opposite to each other axially of the hole 75*g* and the convex portion 75*f* is provided in the construction shown in FIG. 32. The portions 78*a*, 78*d*, 78*e* and 78*g* in FIG. 36 correspond to the portions 75*a*, 75*d*, 75*e* and 75*g* in FIG. 32 respectively.

In attaching the contact member 67 to the attachment portion 75 of the housing 59, the contact member 67 is inserted into the hole 78*a* so that the connecting portion 67*b* thereof is located in the hole 78*g*, as shown in FIG. 37A. Then, one of the terminal portions 67*a* of the contact member 67 projecting from the first cable receiving section 60 is twisted in the direction of arrow A and simultaneously, the other terminal portion 67*a* of the contact member 67 is twisted in the direction opposite arrow A. Consequently, said one terminal portion 67*a* abuts against the first engagement wall 78*d*, engaging it. Said other terminal portion 67*a* abuts against the second engagement wall 78*e*, engaging it. See FIG. 37B. Since the twisting force concentrates upon the narrow connecting portion 67*b*, it is twisted such that the length thereof and accordingly, the gap between each terminal portion 67*a* and the adjacent one are shortened. Thus, when the contact member 67 has been completely twisted, the terminal portions 67*a* thereof are in engagement with the first and second receiving faces 78*b*, 78*c* and the engagement walls 78*d*, 78*e* respectively. Consequently, the contact member 67 is prevented from movement in the direction of rotation and the axial movement.

Although the contact member 67 is inserted into the attachment portion 78 of the housing 59 and then twisted in each of the third and fourth embodiments, the contact member 67 having the terminal portions 67*b* previously twisted to intersect each other may be provided in the housing 59 by the insert molding. Furthermore, means for engaging the covers with the housing should not be limited to those described above.

The foregoing disclosure and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

I claim:

1. An electrical connector for interconnecting parallel multiconductor cables, comprising:

a) a housing with opposite sides having a first cable receiving section for receiving a parallel multiconductor main cable and a second cable receiving section for receiving a parallel multiconductor branch cable respectively;

b) a plurality of contact members each extending through the housing, each contact member having terminal portions projecting from the first and second cable receiving sections so that the main and branch cables are press fitted into the terminal portions in an electrically conductive state respectively;

c) a pair of covers attached to the housing, the covers having cable receiving sections pressing the main and branch cables against the first and second cable receiving sections respectively when the covers are attached to the housing; and d) engagement means for engaging the housing with each cover when each cover has been attached to the housing, the engagement means holding each cover in a provisional engagement state wherein each cover is away from the housing by a predetermined distance when the covers are attached to the housing.

2. An electrical connector according to claim 1, further comprising guide means for guiding each cover in a direction that each cover is attached to the housing.

3. An electrical connector according to claim 1, wherein each cover includes an expanded portion receiving pressing force when attached to the housing.

4. An electrical connector according to claim 1, wherein the housing includes a cable guide for guiding to a predetermined location a distal end of the branch cable received by the second cable receiving section.

5. An electrical connector according to claim 1, wherein a window is provided for exposing outwardly the distal end of the branch cable received by the second cable receiving section, therethrough.

6. An electrical connector according to claim 1, wherein the contact members are press fitted into the housing, each cover has grooves into which the terminals of each contact member are inserted when the covers have been attached to the housing, and a gap between the distal end of the terminal of each contact member and the bottom of the groove of the housing is so set as to be shorter than a distance that the main or branch cable is moved relative to the terminals when each cover has been attached to the housing.

7. An electrical connector according to claim 1, wherein the housing is formed into the shape of a square block, the first and second cable receiving sections are disposed to receive the main and branch cables respectively when the main and branch cables intersect each other, the contact members are arranged to be located on a diagonal of the first and second cable receiving sections, the cutting edges of the terminal portions on the respective first and second cable receiving sections intersect each other, and each cover has grooves into which the terminals of the contact members are inserted when the covers have been attached to the housing.

8. An electrical connector for interconnecting parallel multiconductor cables, comprising:

a) a housing with opposite sides having a first cable receiving section for receiving a parallel multiconductor main cable and a second cable receiving section for receiving a parallel multiconductor branch cable respectively;

b) a plurality of contact members each extending through the housing, each contact member having terminal portions projecting from the first and second cable receiving sections so that the main and branch cables are press fitted into the terminal portions in an electrically conductive state respectively;

c) a pair of covers attached to the housing, the covers having cable receiving sections pressing the main and branch cables against the first and second cable receiving sections respectively when the covers are attached to the housing; and d) engagement means for engaging the housing with each cover when each cover has been attached to the housing, the engagement means holding each cover in first and second provisional engagement states in turn when the covers are attached to the housing, each cover being away from the housing by different distances in the first and second provisional engagement states.

9. An electrical connector according to claim 8, further comprising guide means for guiding each cover in a direction that each cover is attached to the housing.

10. An electrical connector according to claim 8, wherein each cover includes an expanded portion receiving pressing force when attached to the housing.

11. An electrical connector according to claim 8, wherein the housing includes a cable guide for guiding to a predetermined location a distal end of the branch cable received by the second cable receiving section.

12. An electrical connector according to claim 8, wherein a window is provided for exposing outwardly the distal end of the branch cable received by the second cable receiving section.

13. An electrical connector according to claim 8, wherein the contact members are press fitted into the housing, each cover has grooves into which the terminals of each contact member are inserted when the covers have been attached to the housing, and a gap between the distal end of the terminal of each contact member and the bottom of the groove of the housing is so set as to be shorter than a distance that the main or branch cable is moved relative to the terminals when each cover has been attached to the housing.

14. An electrical connector according to claim 8, wherein the housing is formed into the shape of a square block, the first and second cable receiving sections are disposed to receive the main and branch cables respectively when the main and branch cables intersect each other, the contact members are arranged to be located on a diagonal of the first and second cable receiving sections, the cutting edges of the terminal portions on the respective first and second cable receiving sections intersect each other, and each cover has grooves into which the terminals of the contact members are inserted when the covers have been attached to the housing.

15. An electrical connector according to claim 1, wherein the housing is formed into the shape of a square block, the first and second cable receiving sections are disposed to receive the main and branch cables respectively when the main and branch cables intersect each other, each contact member has terminal portions at both ends thereof respectively and a connecting portion having a width smaller than the terminal portions and connecting between the terminals, the housing has a plurality of attachment portions each comprising a through-hole into which the connecting portion of the contact member is inserted so that the connecting portion is located on a diagonal of the first and second cable receiving sections of the housing, first and second engagement walls engaging the respective terminal portions of the contact member so that the terminal portions are located with a rotation angle of approximately 90 degrees about the axis of the contact member therebetween, and a plurality of attachment portions each including first and second receiving portions preventing the respective terminal portions of each contact member from moving axially of each contact member when the terminal portions of each contact member are engaged with the first and second engagement walls respectively, the cover having grooves the terminal portions of each contact member invade when the covers have been attached to the housing.

16. An electrical connector according to claim 15, wherein the distance between the first and second receiving faces of the attachment portion is set to be smaller than the length of the connecting portion of each contact member.

17. An electrical connector according to claim 15, further comprising holding means for holding the terminal portions of each contact member in engagement with the first and second engagement walls of the attachment portion respectively, and wherein the first and second receiving faces of the attachment portion are located to be opposite to each other.

18. An electrical connector according to claim 15, wherein the first and second receiving faces of the attachment portion are located so as not to be opposite to each other.

19. An electrical connector according to claim 8, wherein the housing is formed into the shape of a square block, the first and second cable receiving sections are disposed to receive the main and branch cables respectively when the main and branch cables intersect each other, each contact member has terminal portions at both ends thereof respectively and a connecting portion having a width smaller than the terminal portions and connecting between the terminals, the housing has a plurality of attachment portions each comprising a through-hole into which the connecting portion of the contact member is inserted so that the connecting portion is located on a diagonal between the first and second cable receiving sections of the housing, first and second engagement walls engaging the respective terminal portions of the contact member so that the first and second engagement walls are away from each other by 90 degrees, and a plurality of attachment portions each including first and second receiving portions preventing the respective terminal portions of each contact member from moving axially of each contact member when the terminal portions of each contact member are engaged with the first and second engagement walls respectively, the cover having grooves the terminal portions of each contact member invade when the covers have been attached to the housing.

20. An electrical connector according to claim 19, wherein the distance between the first and second receiving faces of the attachment portion is set to be smaller than the length of the connecting portion of each contact member.

21. An electrical connector according to claim 19, further comprising holding means for holding the terminal portions of each contact member in engagement with the first and second engagement walls of the attachment portion respectively, and wherein the first and second receiving faces of the attachment portion are located to be opposite to each other.

22. An electrical connector according to claim 19, wherein the first and second receiving faces of the attachment portion are located so as not to be opposite to each other.

* * * * *